US008647129B2

(12) United States Patent
Takahashi et al.

(10) Patent No.: US 8,647,129 B2
(45) Date of Patent: Feb. 11, 2014

(54) HOUSINGLESS CONNECTOR

(75) Inventors: Takuya Takahashi, Tokyo (JP); Ryuzo Shimeno, Tokyo (JP); Tetsuya Komoto, Tokyo (JP); Osamu Hashiguchi, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 13/551,832

(22) Filed: Jul. 18, 2012

(65) Prior Publication Data

US 2013/0072037 A1 Mar. 21, 2013

(30) Foreign Application Priority Data

Sep. 16, 2011 (JP) ..... 2011-203457

(51) Int. Cl.
*H01R 12/00* (2006.01)

(52) U.S. Cl.
USPC ..... 439/74; 439/513; 439/931

(58) Field of Classification Search
USPC ..... 439/931, 74, 507, 513
See application file for complete search history.

(56) References Cited

U.S. PATENT DOCUMENTS

| | | | | | |
|---|---|---|---|---|---|
| 3,908,153 | A * | 9/1975 | Cason, Jr. | ..... | 361/220 |
| 4,516,817 | A * | 5/1985 | Deters | ..... | 439/513 |
| 5,562,489 | A * | 10/1996 | Cronin | ..... | 439/507 |
| 6,722,926 | B2 * | 4/2004 | Chevassus-More | ..... | 439/721 |
| 6,855,004 | B2 * | 2/2005 | Soh | ..... | 439/509 |
| 7,011,556 | B2 * | 3/2006 | Miyazawa et al. | ..... | 439/886 |
| 8,500,459 | B2 * | 8/2013 | Niitsu | ..... | 439/74 |
| 2007/0190820 | A1 * | 8/2007 | Yoneta et al. | ..... | 439/74 |
| 2009/0075510 | A1 * | 3/2009 | Kuwahara et al. | ..... | 439/299 |
| 2009/0163054 | A1 * | 6/2009 | Koguchi et al. | ..... | 439/79 |
| 2013/0072037 | A1 * | 3/2013 | Takahashi et al. | ..... | 439/62 |
| 2013/0137305 | A1 * | 5/2013 | Komoto et al. | ..... | 439/626 |

FOREIGN PATENT DOCUMENTS

JP 2003-142183 5/2003

* cited by examiner

*Primary Examiner* — James Harvey
(74) *Attorney, Agent, or Firm* — Maier & Maier, PLLC

(57) ABSTRACT

Provided is a housingless connector in which a plurality of cantilevers arranged in a comb shape and functioning as contacts is hardly damaged. A receptacle connector (housingless connector) is formed of a single metal plate and used to be mounted on a receptacle-side substrate. The receptacle connector includes a plurality of cantilevers arranged in a comb shape and functioning as contacts, and an outer frame body surrounding the cantilevers. The outer frame body includes a pair of side plates sandwiching the cantilevers in a direction parallel to a connector mounting surface of the receptacle-side substrate, and a top plate disposed on an opposite side of the receptacle-side substrate with the cantilevers interposed therebetween.

9 Claims, 28 Drawing Sheets

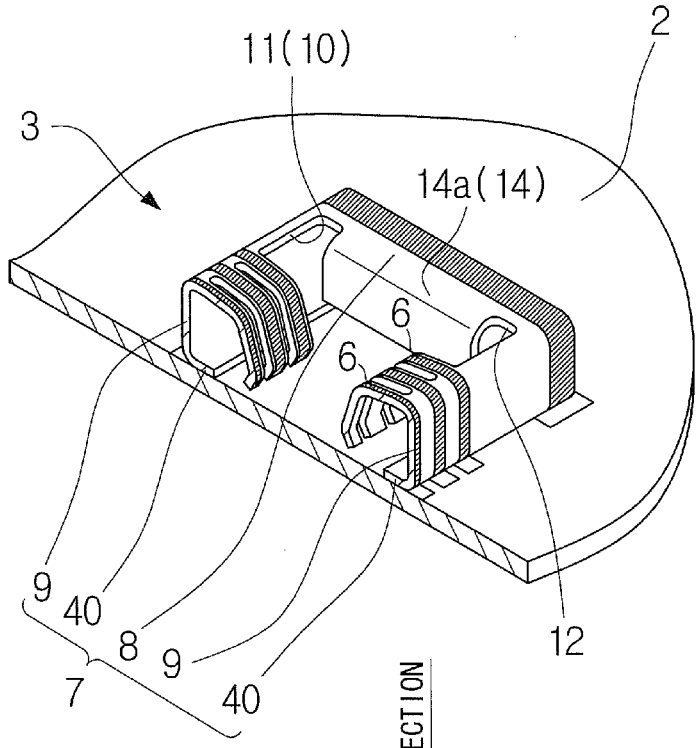
Fig. 14
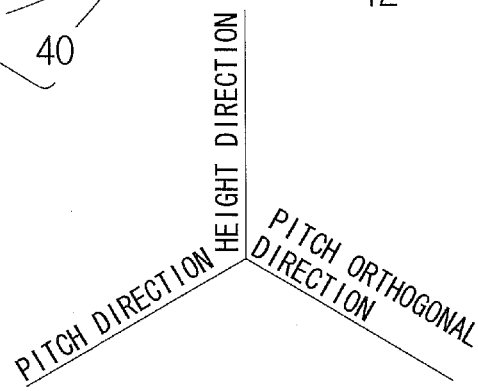

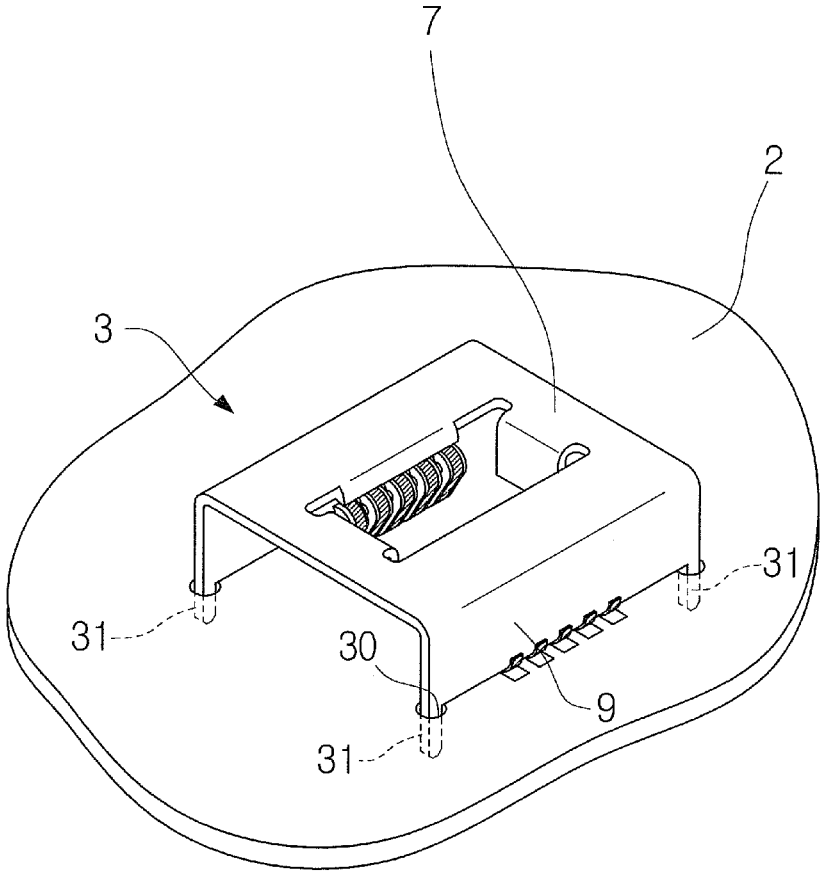
Fig. 27
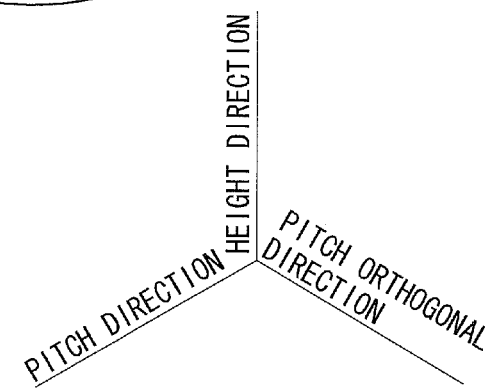

RELATED ART

HOUSINGLESS CONNECTOR

RELATED APPLICATIONS

This application claims priority under 35 U.S.C. §119 to Japanese Patent Application No. 2011-203457, filed Sep. 16, 2011, the disclosure of which is incorporated by reference herein in its entirety.

BACKGROUND OF THE INVENTION

1. Field of the Invention

The present invention relates to a housingless connector.

2. Description of Related Art

As a technique of this type, Japanese Unexamined Patent Application Publication No. 2003-142183 discloses a connector composed of a contact module and a housing. As shown in FIG. 28 of the present application, a contact module 100 includes a base 101 which is formed in a strip shape, and a plurality of contacts 102 which extend out of both sides of the base 101 with the base 101 interposed therebetween and which are arranged like comb teeth. Each of the contacts 102 is formed by stacking a sheet made of a SUS material, an insulating film made of a polyimide resin, and a plating film made of a noble metal material.

Incidentally, the present inventors have developed a housingless connector including a plurality of cantilevers arranged in a comb shape and functioning as contacts. This housingless connector has a problem in that the cantilevers are not held by a housing, so that the cantilevers are liable to be damaged.

Since the connector disclosed in Japanese Unexamined Patent Application Publication No. 2003-142183 includes a housing, the connector does not have the problem described above. Accordingly, the above-mentioned problem cannot be solved by Japanese Unexamined Patent Application Publication No. 2003-142183.

It is an object of the present invention to provide a housingless connector in which a plurality of cantilevers arranged in a comb shape and functioning as contacts is hardly damaged.

SUMMARY OF THE INVENTION

According to an exemplary aspect of the present invention, there is provided a housingless connector that is formed of a single metal plate and used to be mounted on a substrate, the housingless connector including: a plurality of cantilevers arranged in a comb shape and functioning as contacts; and an outer frame body surrounding the plurality of cantilevers.

Preferably, the outer frame body includes a pair of side plates sandwiching the plurality of cantilevers in a direction parallel to the substrate, and a top plate disposed on an opposite side of the substrate with the plurality of cantilevers interposed therebetween.

Preferably, the outer frame body further includes a first substrate fixed portion that is connected to the side plates and fixed to the substrate.

Preferably, the outer frame body further includes a second substrate fixed portion that is connected to the top plate and extends toward the substrate to be fixed to the substrate.

Preferably, the top plate includes an insertion opening into which a counterpart connector is inserted.

Preferably, the top plate includes a seamless peripheral edge surrounding the insertion opening.

Preferably, the peripheral edge has one of an inclined surface and a curved surface.

Preferably, the plurality of cantilevers is formed to extend away from the substrate, and the top plate covers an apex of each of the cantilevers, the apex being farthest from the substrate.

Preferably, the plurality of cantilevers is formed to extend toward the substrate.

Preferably, the plurality of cantilevers is allowed to function as contacts by forming an insulating layer on the metal plate and forming a desired conductive pattern on the insulating layer.

According to an exemplary aspect of the present invention, the plurality of cantilevers is surrounded by the outer frame body, thereby preventing the cantilevers from being damaged.

The above and other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

FIG. 14 is a partially cutaway perspective view of the receptacle connector (second exemplary embodiment);

FIG. 27 is a perspective view of a receptacle connector (a first modified example of the third exemplary embodiment)

DESCRIPTION OF THE EXEMPLARY EMBODIMENTS

<First Exemplary Embodiment>

Figure 1:
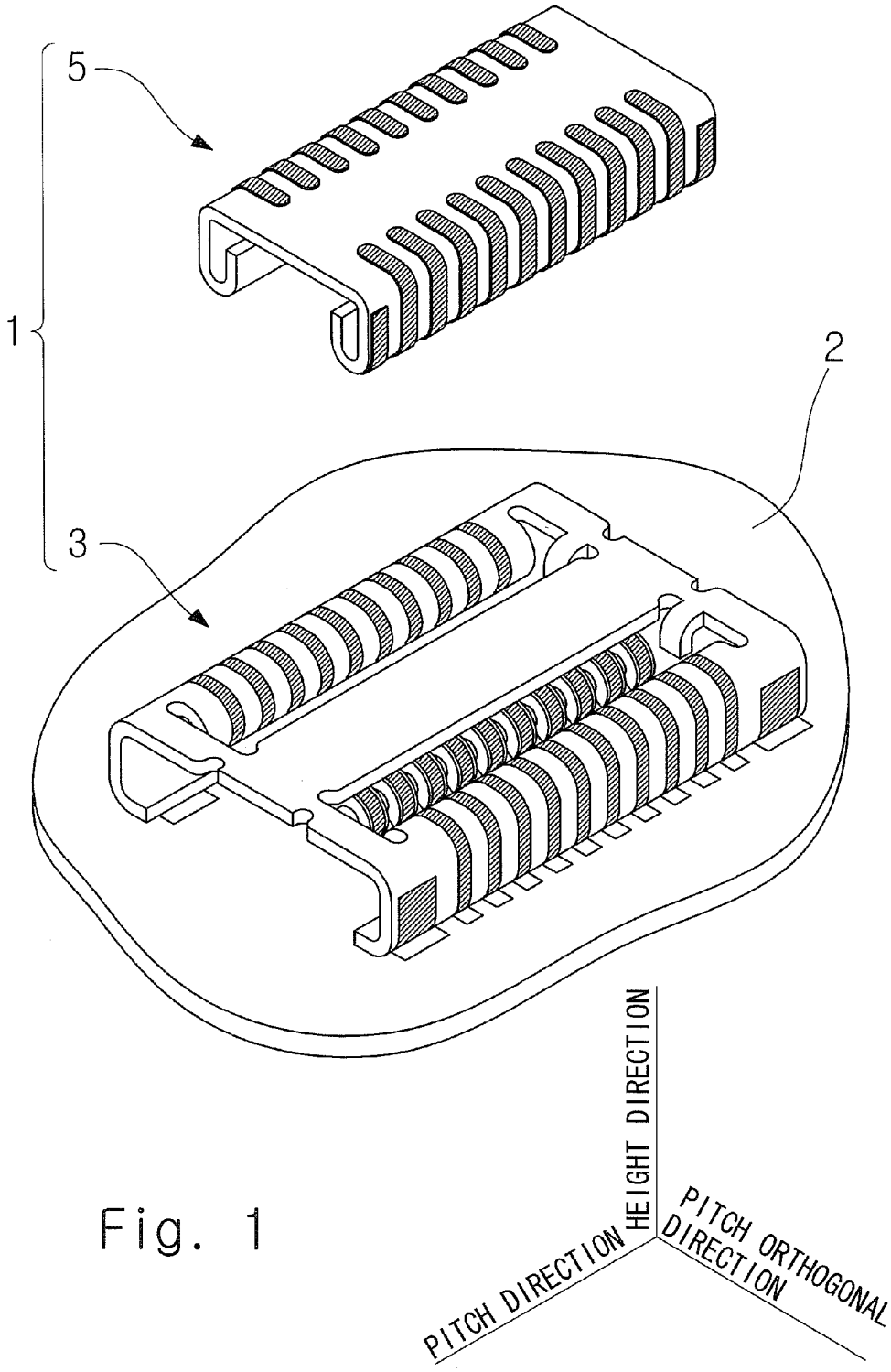
FIG. 1 is a perspective view showing a state where a plug connector is removed from a receptacle connector (first exemplary embodiment)

Referring to FIGS. 1 to 8D, a first exemplary embodiment of the present invention will be described. In the drawings, fine hatching in areas other than sectional areas indicates an image of conductive patterns.

(Connector Unit 1)

Figure 6:
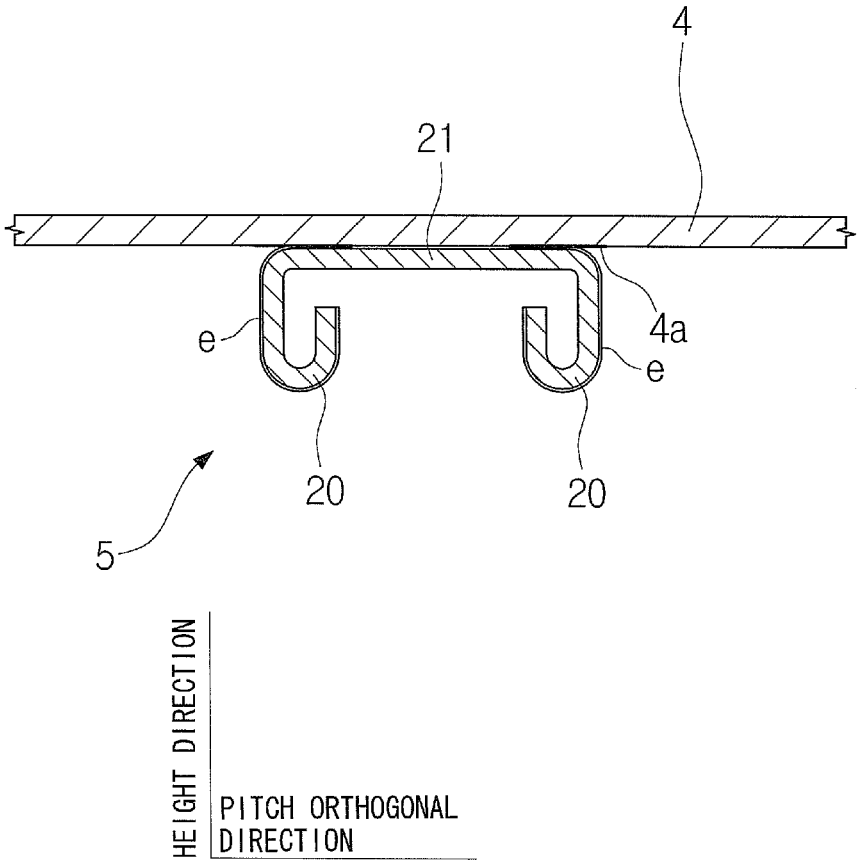
FIG. 6 is a sectional view taken along the line VI-VI of FIG. 5 (first exemplary embodiment)

As shown in FIG. 1, a connector unit 1 includes a receptacle connector 3 (a housingless connector; a first housingless connector) which is used to be mounted on a receptacle-side substrate 2 (a substrate; a first substrate), and a plug connector 5 (a counterpart connector; a second housingless connector) which is used to be mounted on a plug-side substrate 4 (a second substrate; also see FIG. 6).

(Receptacle Connector 3)

Figure 2:
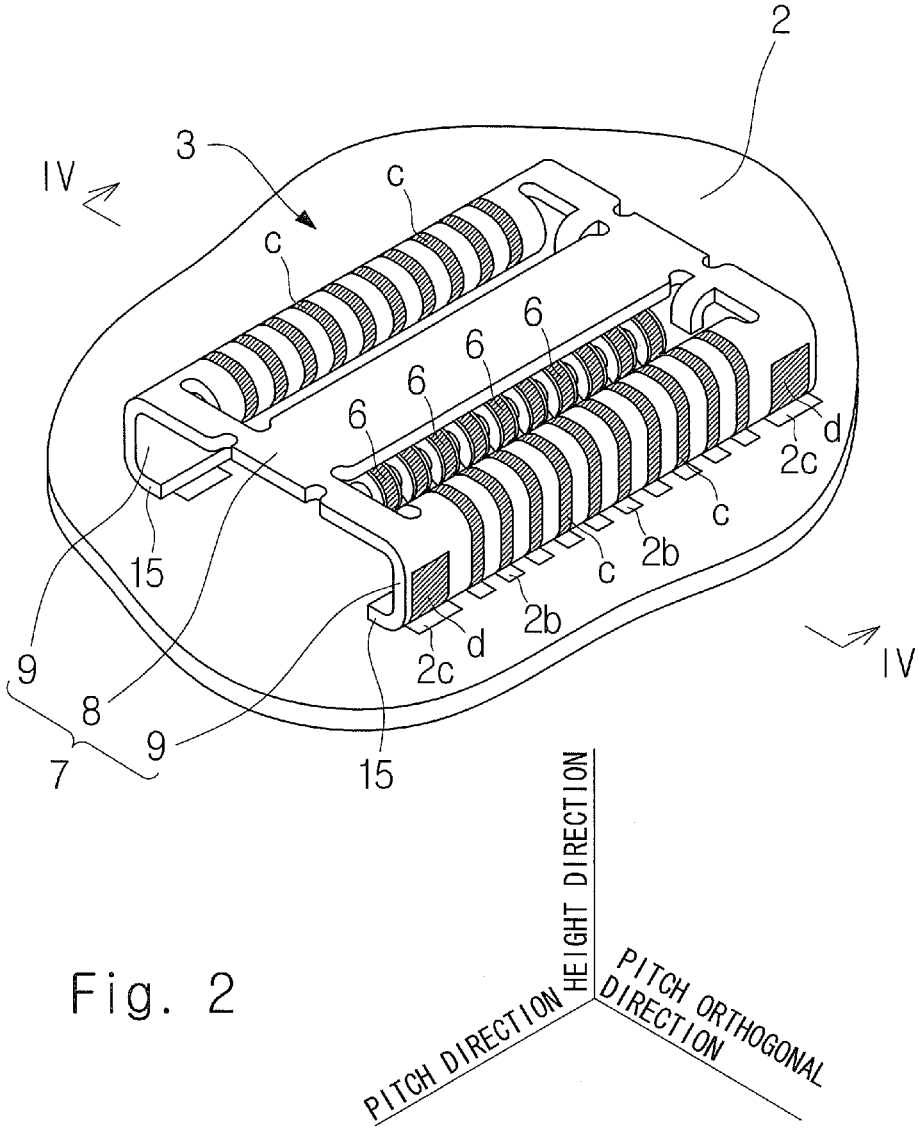
FIG. 2 is a perspective view of the receptacle connector (first exemplary embodiment)
Figure 3:
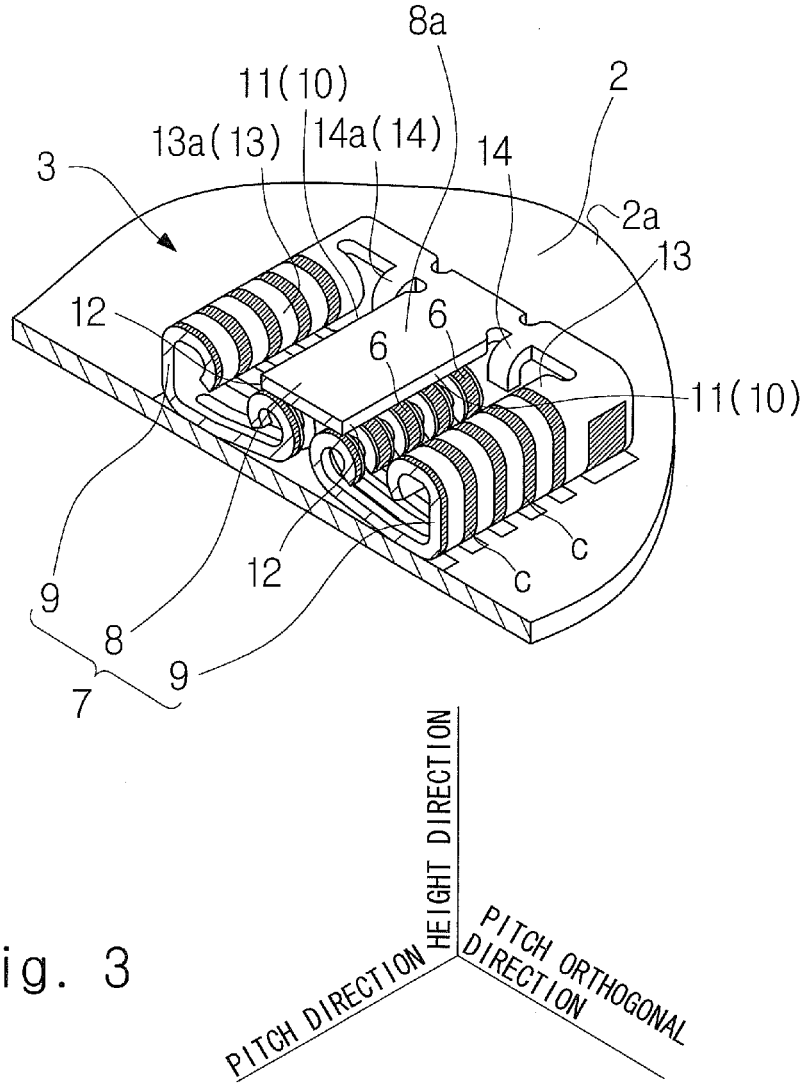
FIG. 3 is a partially cutaway perspective view of the receptacle connector (first exemplary embodiment)
Figure 4:
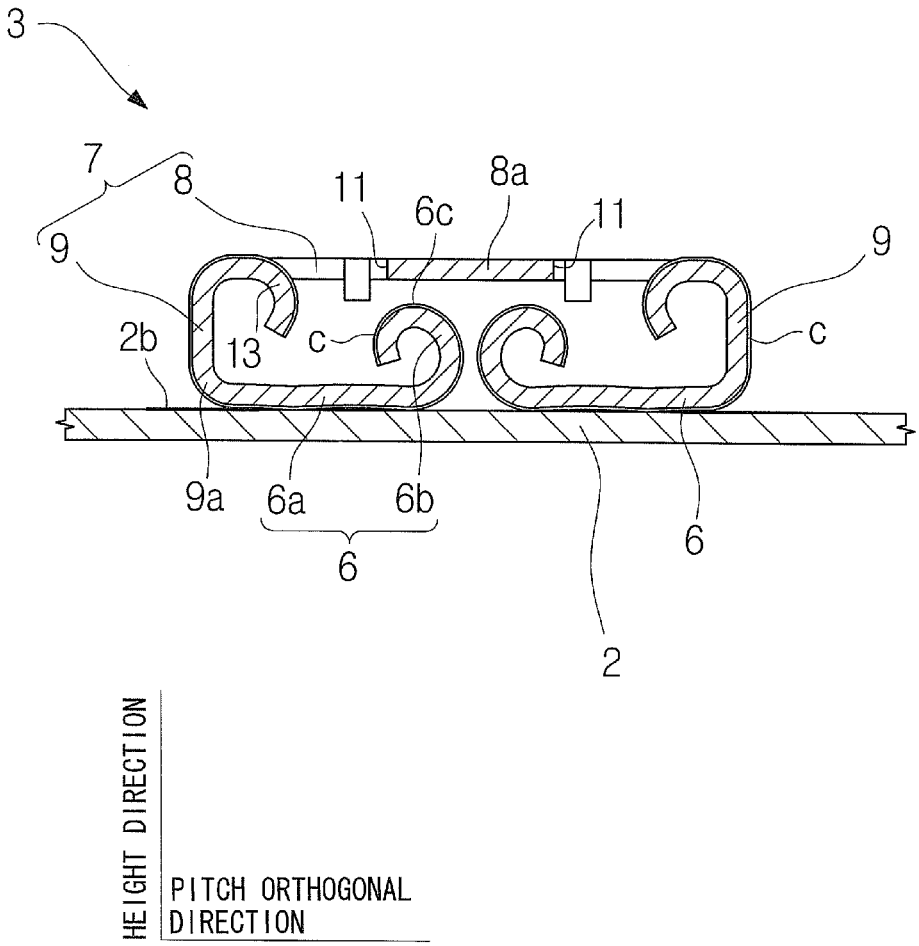
FIG. 4 is a sectional view taken along the line IV-IV of FIG. 2 (first exemplary embodiment)

As shown in FIGS. 2 to 4, the receptacle connector 3 is a so-called housingless type connector which has no housing made of an insulating material. The receptacle connector 3 includes a plurality of cantilevers 6 which is arranged in a comb shape and functions as contacts, and an outer frame body 7 which surrounds the plurality of cantilevers 6. As shown in FIG. 3, the plurality of cantilevers 6 are arranged in two rows along a direction parallel to a connector mounting surface 2*a* of the receptacle-side substrate 2.

Referring now to FIG. 3, the terms "pitch direction", "pitch orthogonal direction", and "height direction" are defined. The term "pitch direction" refers to a direction which is included in the direction parallel to the connector mounting surface 2*a* of the receptacle-side substrate 2 and in which a number of cantilevers 6 are arranged. In the "pitch direction", a direction approaching the center of the receptacle connector 3 is defined as "pitch center direction" and a direction away from the center of the receptacle connector 3 is defined as "pitch anti-center direction". The term "pitch orthogonal direction" refers to a direction which is included in the direction parallel to the connector mounting surface 2*a* of the receptacle-side substrate 2 and which is orthogonal to the pitch direction. In the "pitch orthogonal direction", a direction approaching the center of the receptacle connector 3 is defined as "pitch orthogonal center direction" and a direction away from the center of the receptacle connector 3 is defined as "pitch orthogonal anti-center direction". The term "height direction" refers to a direction which is orthogonal to the connector mounting surface 2*a* of the receptacle-side substrate 2. In the "height direction", a direction approaching the connector mounting surface 2*a* of the receptacle-side substrate 2 is defined as "substrate approaching direction" and a direction away from the connector mounting surface 2*a* of the receptacle-side substrate 2 is defined as "substrate separating direction".

(Outer Frame Body 7)

As shown in FIGS. 2 to 4, the outer frame body 7 includes a top plate 8 and a pair of side plates 9.

(Outer Frame Body 7: Top Plate 8)

As shown in FIG. 3, the top plate 8 is disposed on an opposite side of the receptacle-side substrate 2 with the plurality of cantilevers 6 interposed therebetween, and is substantially parallel to the receptacle-side substrate 2. The top plate 8 includes an insertion opening unit 10 into which the plug connector 5 is inserted. The insertion opening unit 10 is formed of a pair of insertion openings 11. That is, the top plate 8 includes the pair of insertion openings 11. In other words, the top plate 8 is formed to surround the insertion openings 11. The pair of insertion openings 11 is arranged in the pitch orthogonal direction. Each of the insertion openings 11 is formed to be elongated in the pitch direction. The top plate 8 includes seamless peripheral edges 12 which surround the insertion openings 11. First curved portions 13 and a pair of second curved portions 14, which are curved so as to hang down in the substrate approaching direction, are formed at the peripheral edges 12. The first curved portions 13 are formed on the side of the pitch orthogonal anti-center direction when viewed from the insertion openings 11. The pair of second curved portions 14 is formed on the side of the pitch anti-center direction when viewed from the insertion openings 11. Each of the first curved portions 13 has a first curved surface 13*a* (curved surface). Each of the second curved portions 14 has a second curved surface 14*a* (curved surface).

(Outer Frame Body 7: Side Plates 9)

As shown in FIG. 3, the pair of side plates 9 is arranged so as to sandwich the plurality of cantilevers 6 in the direction parallel to the connector mounting surface 2*a* of the receptacle-side substrate 2. The pair of side plates 9 is connected to an end in the pitch orthogonal direction of the top plate 8, and is formed to extend in the substrate approaching direction. The pair of side plates 9 is substantially orthogonal to the receptacle-side substrate 2. As shown in FIG. 2, hold-downs 15 (first substrate fixed portions) which are used to solder the receptacle connector 3 to the receptacle-side substrate 2 are formed at lower ends of the end portions in the pitch direction of the side plates 9. The hold-downs 15 are connected to the respective side plates 9 and formed to be bent in the pitch orthogonal center direction from the side plates 9.

(Cantilevers 6)

As shown in FIG. 4, each of the cantilevers 6 extends away from the receptacle-side substrate 2. Specifically, each of the cantilevers 6 includes a linear portion 6*a* which is connected to a lower end 9*a* of the corresponding side plate 9 of the outer frame body 7 and extends in the pitch orthogonal center direction; and a curved portion 6*b* which is connected to the linear portion 6*a* and curved to be directed toward the substrate separating direction, the pitch orthogonal anti-center direction, and the substrate approaching direction in this order. It can be said that each of the cantilevers 6 is formed to extend away from the receptacle-side substrate 2 due to the presence of the curved portion 6*b*. An apex 6*c* is a portion of each of the cantilevers 6 that is farthest from the receptacle-side substrate 2. The apex 6*c* is covered by the top plate 8. Specifically, the apex 6*c* of each of the cantilevers 6 is covered by a top plate central portion 8*a*. The top plate central portion 8*a* is a portion of the top plate 8 which partitions the pair of insertion openings 11.

(Conductive Patterns c)

The receptacle connector 3 configured as described above has a plurality of conductive patterns c as shown in FIG. 2. The conductive patterns c are formed so as to correspond to the respective cantilevers 6. That is, the number of the conductive patterns c is the same as the number of the cantilevers 6.

As shown in FIGS. 3 and 4, the conductive patterns c are formed over the cantilevers 6, the side plates 9, and the top plate 8. Specifically, the conductive patterns c are formed in the range from the curved portion 6*b* of each of the cantilevers 6 to each of the first curved portions 13 of the top plate 8. The conductive patterns c are soldered to respective electrode pads 2*b* of the receptacle-side substrate 2.

(Hold-down Patterns d)

As shown in FIG. 2, the receptacle connector 3 has a plurality of hold-down patterns d. The hold-down patterns d are formed to extend over the hold-downs 15 and the side plates 9. The hold-down patterns d are soldered to respective holding-down pads 2*c* of the receptacle-side substrate 2, thereby allowing the hold-downs 15 to be fixed to the receptacle-side substrate 2.

(Plug Connector 5)

Figure 5:
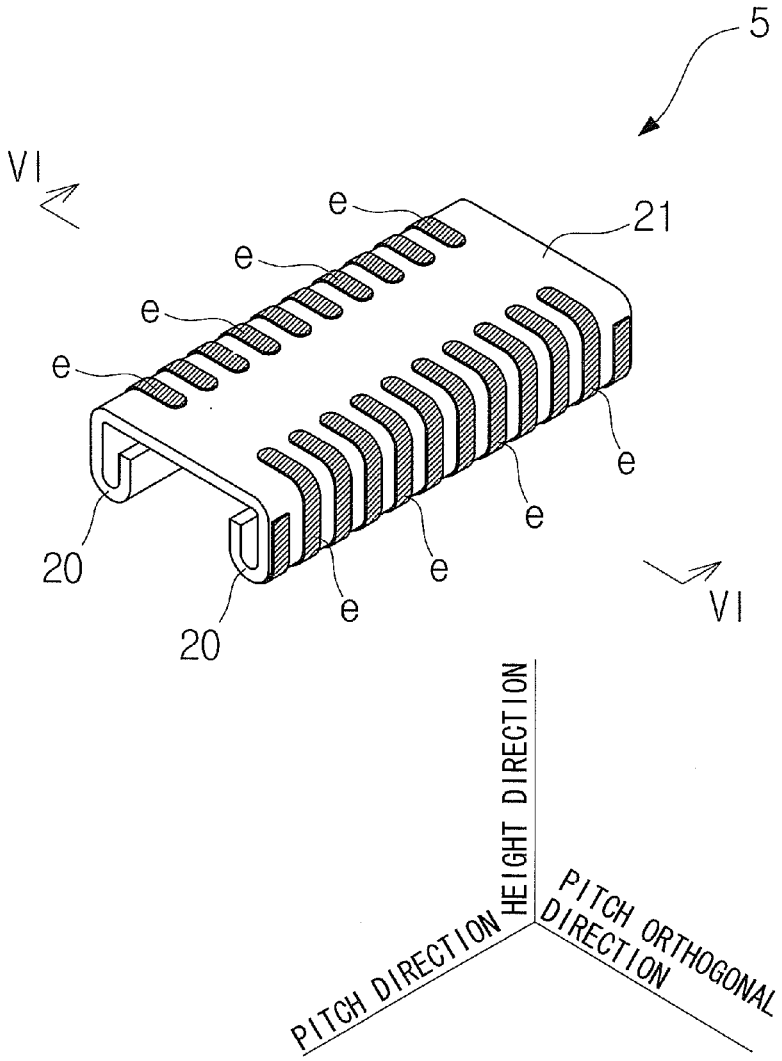
FIG. 5 is a perspective view of the plug connector (first exemplary embodiment)

As shown in FIG. 5, the plug connector 5 is also a so-called housingless type connector which has no housing made of an insulating material, as with the receptacle connector 3.

As shown in FIGS. 5 and 6, the plug connector 5 includes a pair of U-shaped portions 20 functioning as contacts, and a connecting plate 21 that connects the pair of U-shaped portions 20. Note that FIG. 6 depicts the plug-side substrate 4, for convenience of explanation.

Each of the U-shaped portions 20 is formed in a substantially U-shape that extends in the substrate approaching direction (the direction approaching the receptacle-side substrate 2; the same hereinafter) from the end in the pitch orthogonal direction of the connecting plate 21, curves in the pitch orthogonal center direction, and further extend in the substrate separating direction (the direction separating from the receptacle-side substrate 2; the same hereinafter).

(Conductive Patterns e)

The plug connector 5 has a plurality of conductive patterns e. The conductive patterns e are formed so as to correspond to the respective cantilevers 6 (conductive patterns c). That is, the number of the conductive patterns e is the same as the number of the cantilevers 6 (conductive patterns c).

As shown in FIGS. 5 and 6, the conductive patterns e are formed over the U-shaped portions 20 and the connecting plate 21. Each of the conductive patterns e is soldered to an electrode pad 4*a* of the plug-side substrate 4.

(Operation)

Figure 7:
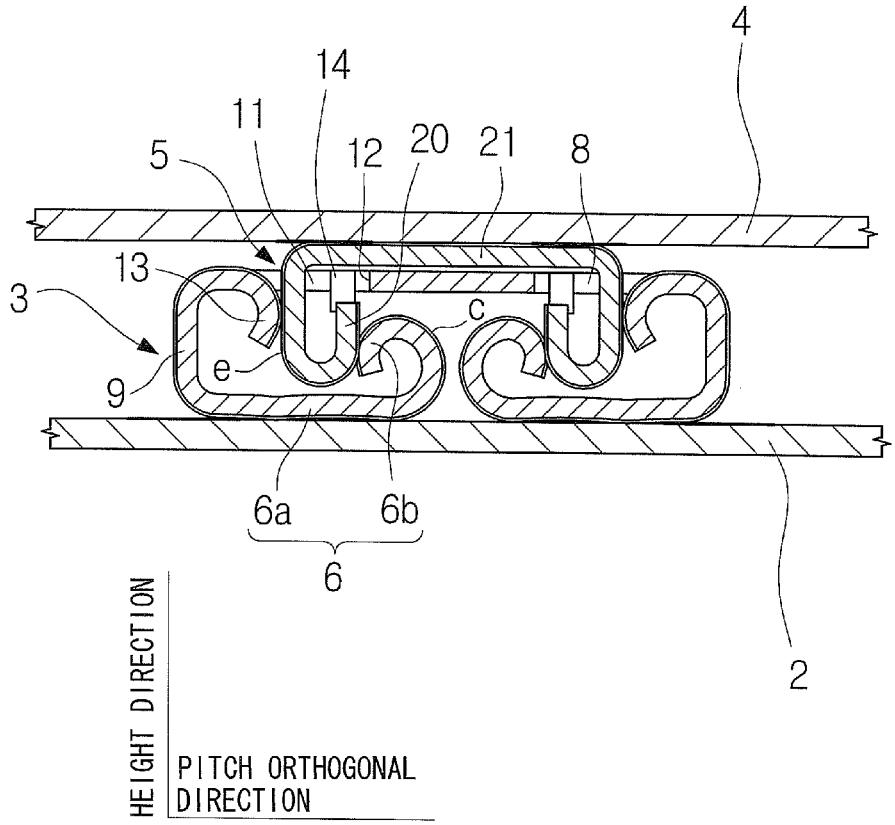
FIG. 7 is a sectional view showing a state where the receptacle connector and the plug connector are fit together (first exemplary embodiment)

Next, an operation of the connector unit 1 will be described. Referring first to FIGS. 4 and 6, the receptacle connector 3 is mounted on the receptacle-side substrate 2 and the plug connector 5 is mounted on the plug-side substrate 4. Referring next to FIG. 7, the U-shaped portions 20 of the plug connector 5 are inserted into the respective insertion openings 11 of the receptacle connector 3. At the peripheral edges 12 of the insertion opening 11, the first curved portions 13 and the second curved portions 14 are formed, thereby allowing the U-shaped portions 20 of the plug connector 5 to be easily inserted into the respective insertion openings 11 of the receptacle connector 3. When the U-shaped portions 20 of the plug connector 5 are inserted into the respective insertion openings 11 of the receptacle connector 3, the U-shaped portions 20 of the plug connector 5 push the curved portion 6*b* of each cantilever 6 in the pitch orthogonal center direction. Then, the cantilevers 6 are allowed to strongly contact the respective U-shaped portions 20 of the plug connector 5 by a self elastic restoring force. This contact achieves continuity between each conductive pattern c of the receptacle connector 3 and each conductive pattern e of the plug connector 5.

(Manufacturing Method)

Figure 8A:
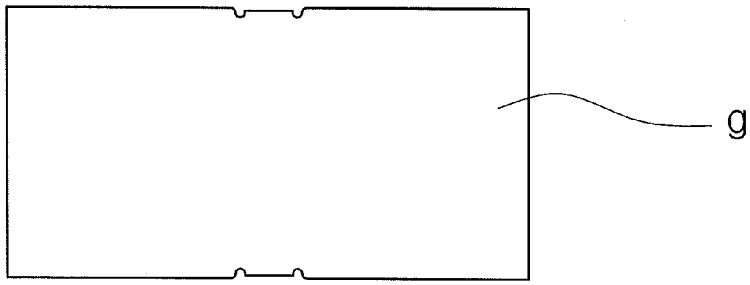
FIGS. 8A to 8D are diagrams showing a method for manufacturing the receptacle connector (first exemplary embodiment)
Figure 8B:
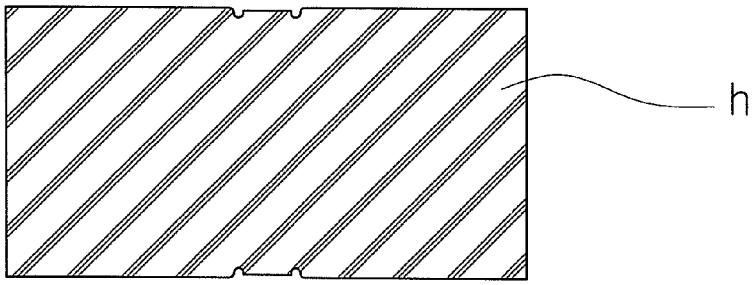
Figure 8C:
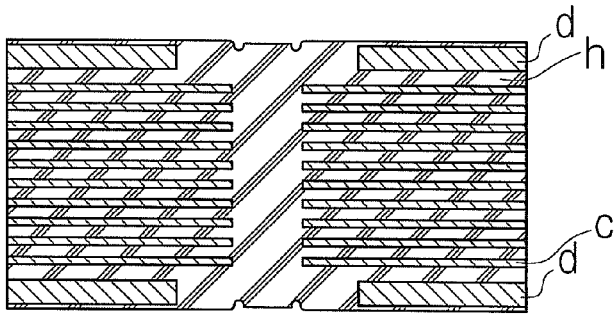
Figure 8D:
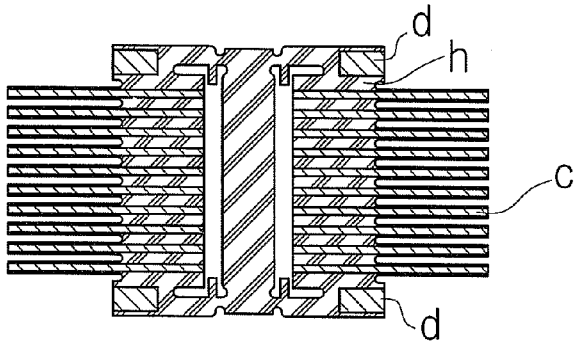

Referring next to FIGS. 8A to 8D, a method for manufacturing the receptacle connector 3 will be described. As shown in FIG. 8A, the receptacle connector 3 is formed of a single metal plate g. First, as shown in FIG. 8B, an insulating layer h is formed on one surface of the metal plate g. Next, as shown in FIG. 8C, desired conductive patterns c and hold-down patterns d are formed on the insulating layer h. Then, as shown in FIG. 8D, an unnecessary portion is removed by a punch process or the like. In the state shown in FIG. 8D, a predetermined bending process is carried out, thereby completing the receptacle connector 3 as shown in FIG. 2.

A method for manufacturing the plug connector 5 is substantially the same as the method for manufacturing the receptacle connector 3, so the description thereof is omitted.

The first exemplary embodiment of the present invention has been described above. In short, the first exemplary embodiment has the following features.

The receptacle connector 3 (housingless connector) is formed of a single metal plate g and is used to be mounted on the receptacle-side substrate 2. The receptacle connector 3 includes the plurality of cantilevers 6 arranged in a comb shape and functioning as contacts, and the outer frame body 7 surrounding the plurality of cantilevers 6. According to the configuration described above, the plurality of cantilevers 6 is surrounded by the outer frame body 7, thereby preventing the cantilevers from being damaged.

The outer frame body 7 includes the pair of side plates 9 sandwiching the plurality of cantilevers 6 in the direction parallel to the connector mounting surface 2*a* of the receptacle-side substrate 2, and the top plate 8 disposed on the opposite side of the receptacle-side substrate 2 with the plurality of cantilevers 6 interposed therebetween. According to the configuration described above, the plurality of cantilevers 6 is surrounded to be covered by the outer frame body 7, thereby further preventing the cantilevers from being damaged.

The outer frame body 7 further includes the hold-downs 15 (first substrate fixed portions) which are connected to the side plates 9 and fixed to the connector mounting surface 2*a* of the receptacle-side substrate 2. In the configuration described above, when the hold-downs 15 are fixed to the connector mounting surface 2*a* of the receptacle-side substrate 2, the receptacle connector 3 is fixed to the receptacle-side substrate 2.

The top plate 8 includes the insertion openings 11 into which the plug connector 5 (counterpart connector) is inserted. In the configuration described above, when the receptacle connector 3 and the plug connector 5 are fit together, the plug connector 5 is inserted into the insertion openings 11, thereby allowing the plug connector 5 to contact the plurality of cantilevers 6. During the insertion, the top plate 8 itself exerts a guide function of guiding the plug connector 5 to the plurality of cantilevers 6.

The top plate 8 includes the seamless peripheral edges 12 surrounding the insertion openings 11. According to the configuration described above, the above-mentioned guide function can be achieved more smoothly, compared with the case where the peripheral edges 12 have a cut.

Each of the peripheral edges 12 has the first curved surface 13*a* (curved surface) and the second curved surface 14*a* (curved surface). According to the configuration described above, the above-mentioned guide function can be achieved more smoothly.

Note that an inclined surface that is inclined in the substrate approaching direction may be formed in place of the first curved surface 13*a* and the second curved surface 14*a*.

The plurality of cantilevers 6 is formed to extend away from the receptacle-side substrate 2, and the top plate 8 covers the apex 6*c* which is a portion of each of the cantilevers 6 that is farthest from the receptacle-side substrate 2. According to the configuration described above, in the case of inserting the plug connector 5 into the insertion openings 11, the plug connector 5 is prevented from causing each cantilever 6 to be deformed to buckle.

Note that, for reference, the dimension in the height direction of the receptacle connector 3 is, for example, 0.8 mm; the dimension in the pitch orthogonal direction is, for example, 2.5 mm; and the pitch of the cantilevers 6 is, for example, 0.2 mm.

<First Exemplary Embodiment: First Modified Example>

Figure 9:
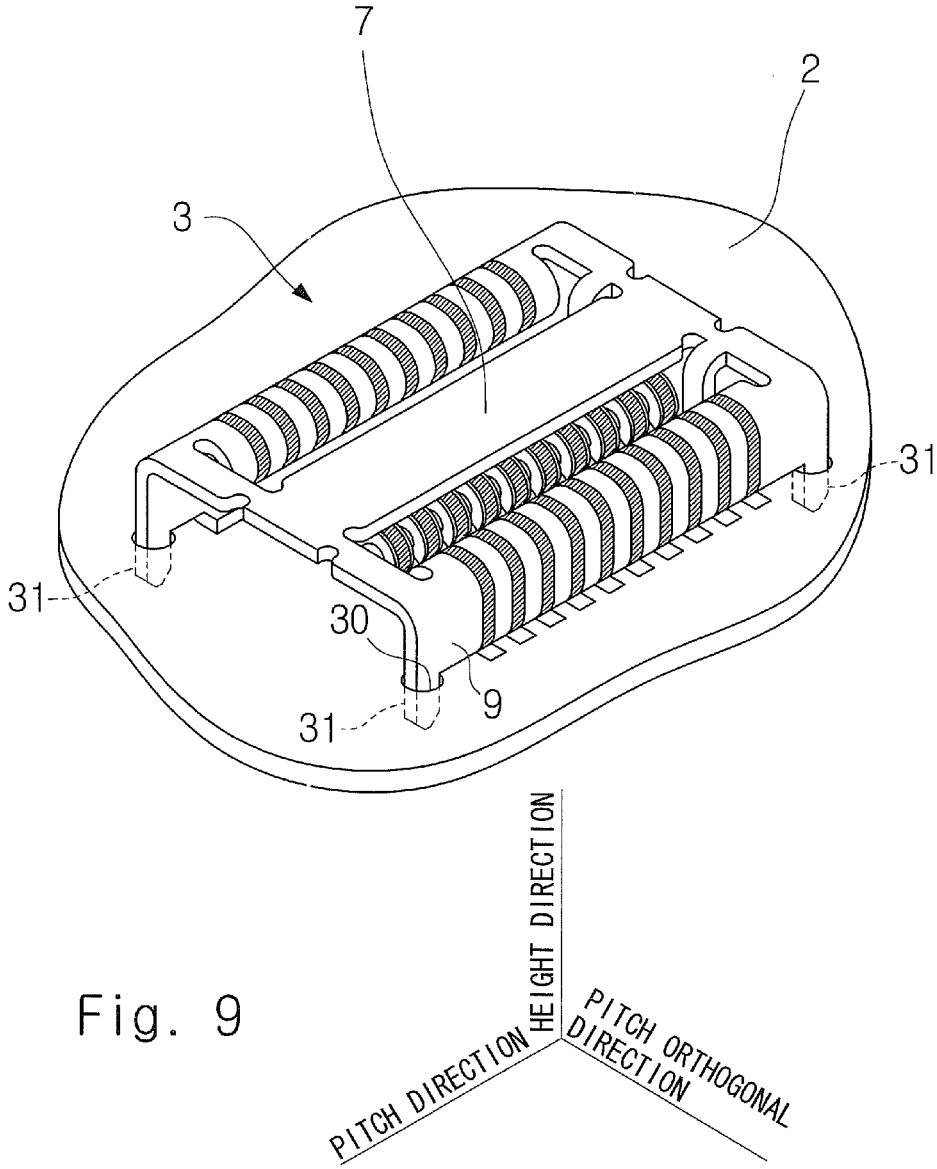
FIG. 9 is a perspective view of a receptacle connector (a first modified example of the first exemplary embodiment)

Referring next to FIG. 9, a first modified example of the first exemplary embodiment will be described.

In the first exemplary embodiment described above, to mount the receptacle connector 3 on the receptacle-side substrate 2, the receptacle connector 3 includes the hold-downs 15 which are soldered to the receptacle-side substrate 2 at the lower ends of the end portions in the pitch direction of the side plates 9 as shown in FIG. 2.

Alternatively, as shown in FIG. 9, the receptacle connector 3 may include pins 31 (first substrate fixed portions) which are inserted into through-holes 30 formed in the receptacle-side substrate 2 and are soldered to the receptacle-side substrate 2 at the lower ends of the end portions in the pitch direction of the side plates 9. That is, the outer frame body 7 may further include the pins 31 which are connected to the respective side plates 9 and fixed to the receptacle-side substrate 2. The presence of the pins 31 improves the strength for mounting the receptacle connector 3 to the receptacle-side substrate 2.

<First Exemplary Embodiment: Second Modified Example>

Figure 10:
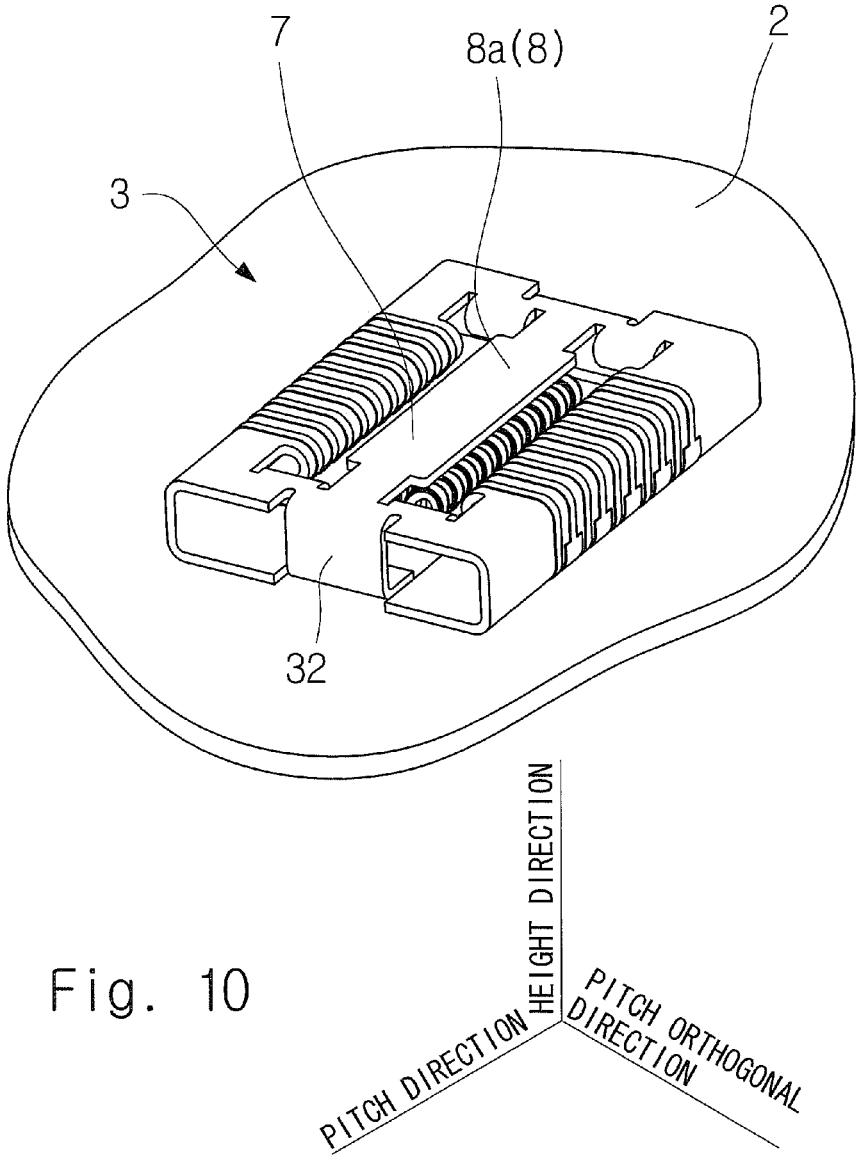
FIG. 10 is a perspective view of a receptacle connector (a second modified example of the first exemplary embodiment)

Referring next to FIG. 10, a second modified example of the first exemplary embodiment will be described.

As shown in FIG. 10, the receptacle connector 3 may further include a hold-down 32 (second substrate fixed portion) which is soldered to the receptacle-side substrate 2 at an end portion in the pitch direction of the top plate central portion 8*a* of the top plate 8. That is, the outer frame body 7 may further include the hold-down 32 which is connected to the top plate central portion 8*a* of the top plate 8 and extends toward the receptacle-side substrate 2 to be fixed to the receptacle-side substrate 2. The presence of the hold-down 32 improves the strength of the top plate 8. Further, the presence of the hold-down 32 improves the strength for mounting the receptacle connector 3 to the receptacle-side substrate 2.

<First Exemplary Embodiment: Third Modified Example>

Figure 11:
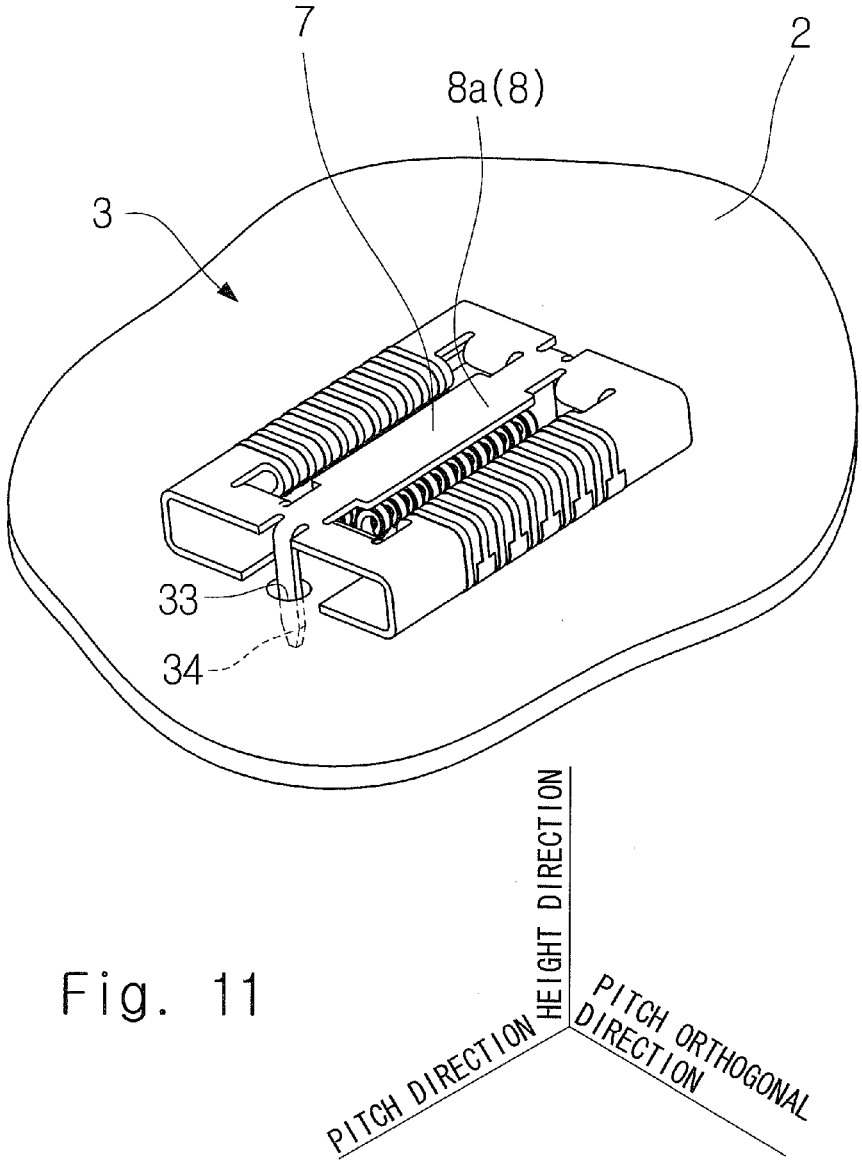
FIG. 11 is a perspective view of a receptacle connector (a third modified example of the first exemplary embodiment)

Referring next to FIG. 11, a third modified example of the first exemplary embodiment will be described.

As shown in FIG. 11, the receptacle connector 3 may further include a pin 34 (second substrate fixed portion) at an end portion in the pitch direction of the top plate central portion 8*a* of the top plate 8. The pin 34 is inserted into each through-hole 33 formed in the receptacle-side substrate 2 and soldered to the receptacle-side substrate 2. In other words, the outer frame body 7 may further include the pin 34 which is connected to the top plate central portion 8*a* of the top plate 8 and extends toward the receptacle-side substrate 2 to be fixed to the receptacle-side substrate 2. The presence of the pin 34 improves the strength of the top plate 8. Further, the presence of the pin 34 improves the strength for mounting the receptacle connector 3 to the receptacle-side substrate 2.

<Second Exemplary Embodiment>

Referring next to FIGS. 12 to 18, a second exemplary embodiment of the present invention will be described. Herein, the differences between this exemplary embodiment and the first exemplary embodiment described above will be mainly described, and a repeated description is omitted as needed. The components corresponding to the components of the first exemplary embodiment described above are denoted by the same reference numerals as a general rule.

(Connector Unit 1)

Figure 12:
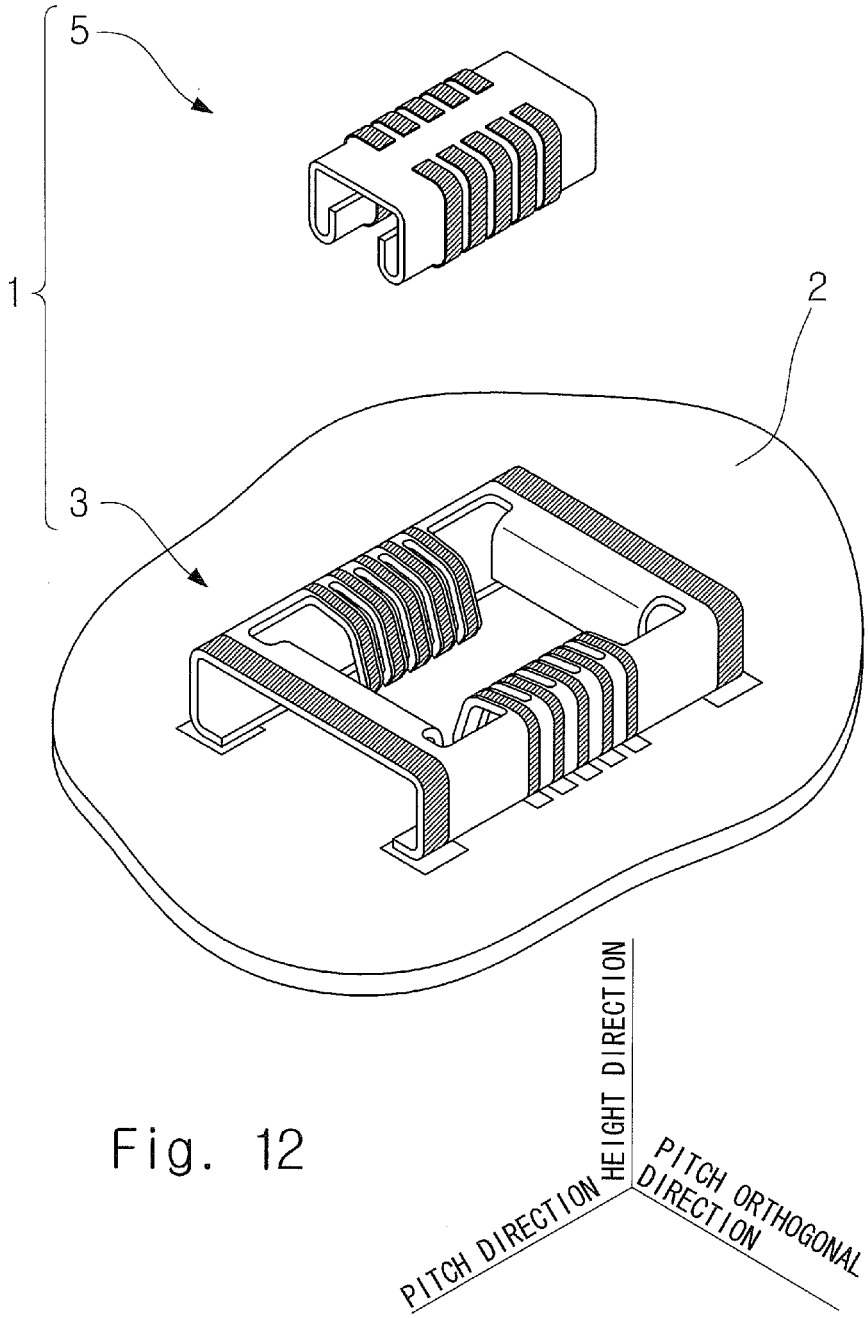
FIG. 12 is a perspective view showing a state where a plug connector is removed from a receptacle connector (second exemplary embodiment)
Figure 17:
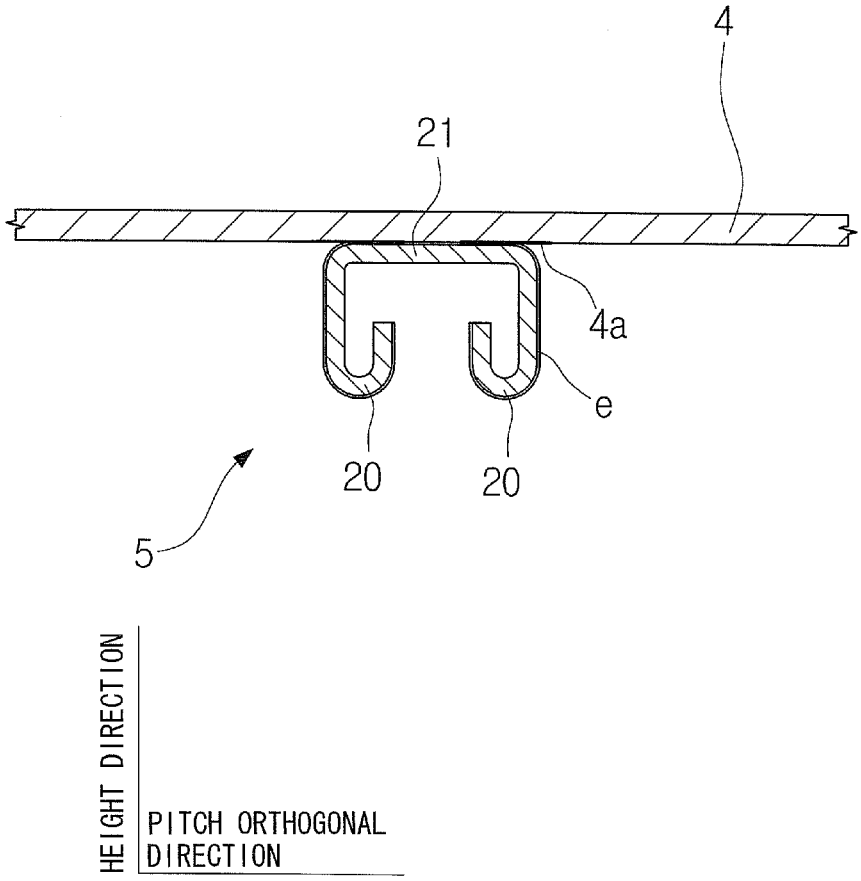
FIG. 17 is a sectional view taken along the line XVII-XVII of FIG. 16 ( second exemplary embodiment)

As shown in FIG. 12, the connector unit 1 includes the receptacle connector 3 which is used to be mounted on the receptacle-side substrate 2, and the plug connector 5 which is used to be mounted on the plug-side substrate 4 (also see FIG. 17).

(Receptacle Connector 3)

Figure 13:
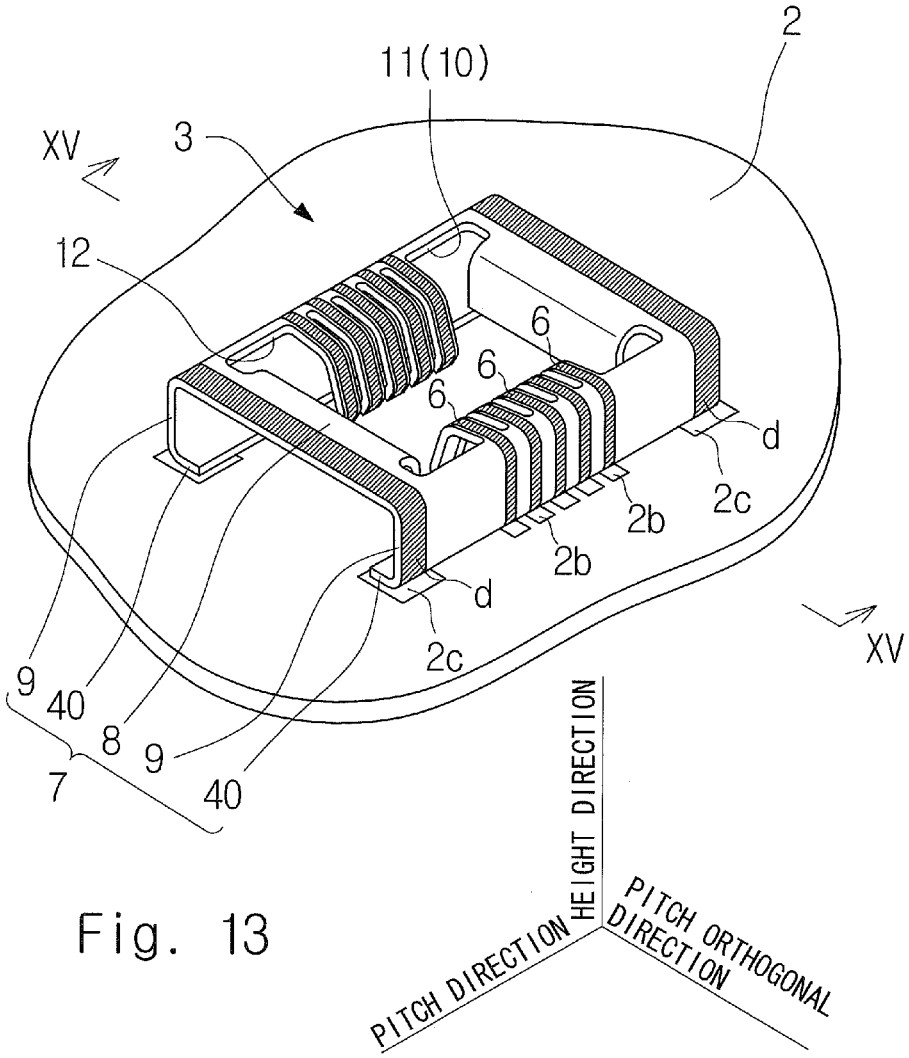
FIG. 13 is a perspective view of the receptacle connector (second exemplary embodiment)
Figure 15:
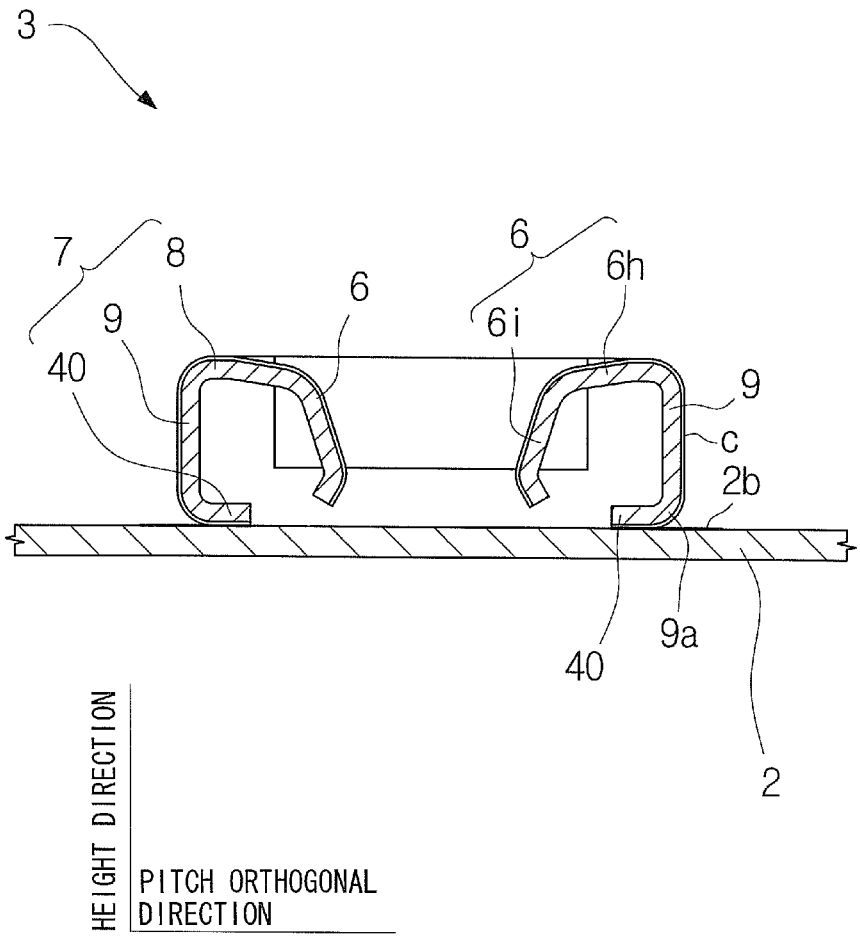
FIG. 15 is a sectional view taken along the line XV-XV of FIG. 13 (second exemplary embodiment)

As shown in FIGS. 13 to 15, the receptacle connector 3 includes the plurality of cantilevers 6 and the outer frame body 7.

(Outer Frame Body 7)

As shown in FIGS. 13 to 15, the outer frame body 7 includes the top plate 8, the pair of side plates 9, and a pair of base plates 40 (first substrate fixed portions).

(Outer Frame Body 7: Top Plate 8)

The top plate 8 includes the insertion opening unit 10 into which the plug connector 5 is inserted. As shown in FIGS. 13 and 14, the insertion opening unit 10 is formed of a single insertion opening 11. That is, the top plate 8 includes a single insertion opening 11. In other words, the top plate 8 is annularly formed to surround a single insertion opening 11. The top plate 8 includes the seamless peripheral edge 12 surrounding the insertion opening 11. As shown in FIG. 14, the pair of second curved portions 14 is formed at the peripheral edge 12. The pair of second curved portions 14 is formed on the side of the pitch anti-center direction when viewed from the insertion opening 11. Each of the second curved portions 14 has the second curved surface 14*a* (curved surface).

(Outer Frame Body 7: Base Plates 40)

As shown in FIG. 15, the base plates 40 are respectively connected to the lower ends 9*a* of the side plates 9 and formed to be bent in the pitch orthogonal center direction.

(Cantilevers 6)

As shown in FIGS. 13 to 15, each of the cantilevers 6 is formed to extend toward the receptacle-side substrate 2. Specifically, as shown in FIGS. 14 and 15, each of the cantilevers 6 includes a linear portion 6*h* which is connected to the peripheral edge 12 of the insertion opening 11 of the top plate 8 of the outer frame body 7 and extends in the pitch orthogonal center direction; and a bent portion 6*i* which is connected to the linear portion 6*h* and extends in the substrate approaching direction while expanding in the pitch orthogonal center direction. It can be said that the presence of the bent portion 6*i* allows formation of the cantilevers 6 that extend toward the receptacle-side substrate 2.

(Conductive Patterns c)

As shown in FIG. 15, the conductive patterns c are formed over the cantilevers 6, the top plate 8, the side plates 9, and the base plates 40. Specifically, the conductive patterns c are formed in the range from the bent portion 6*i* of each of the cantilevers 6 to each of the base plates 40. The conductive patterns c are soldered to the respective electrode pads 2*b* of the receptacle-side substrate 2.

(Hold-down Patterns d)

As shown in FIG. 13, the receptacle connector 3 has a pair of hold-down patterns d. The hold-down patterns d are formed over the base plate 40, the side plate 9, the top plate 8, the side plate 9, and the base plate 40 at the end portion in the pitch anti-center direction of the outer frame body 7. The hold-down patterns d are soldered to the respective holding-down pads 2*c* of the receptacle-side substrate 2.

(Plug Connector 5)

Figure 16:
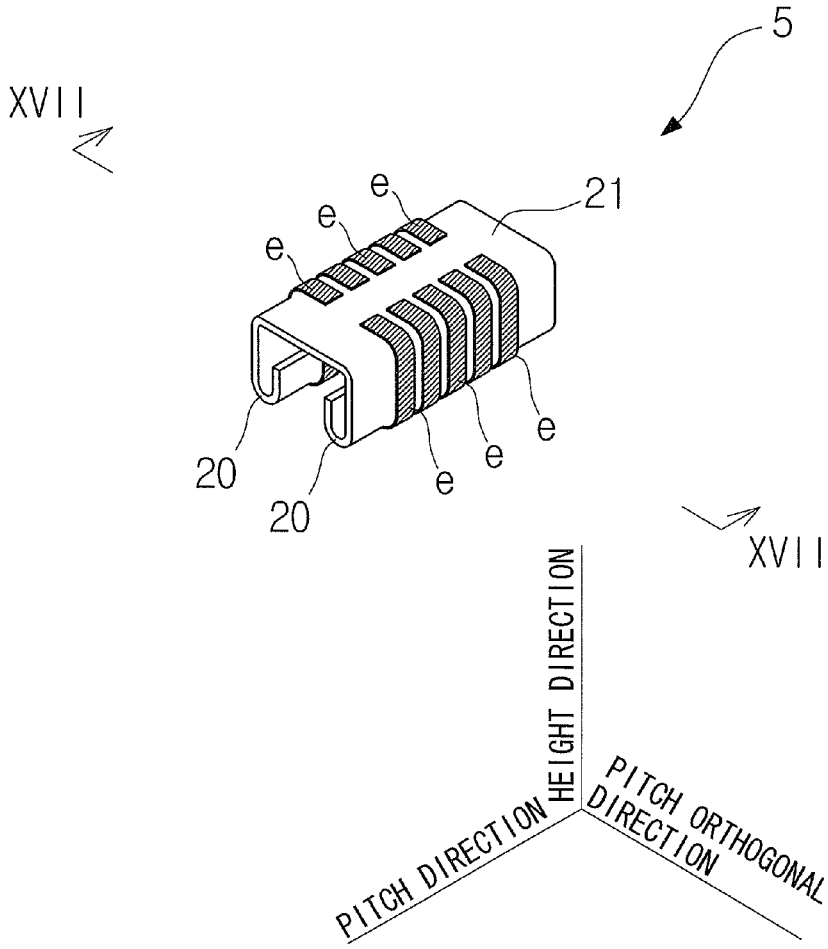
FIG. 16 is a perspective view of the plug connector (second exemplary embodiment)

As shown in FIGS. 16 and 17, the plug connector 5 includes the pair of U-shaped portions 20 functioning as contacts, and the connecting plate 21 that connects the pair of U-shaped portions 20. Note that FIG. 17 depicts the plug-side substrate 4, for convenience of explanation.

(Conductive Patterns e)

The plug connector 5 has the plurality of conductive patterns e. The conductive patterns e are formed over the U-shaped portions 20 and the connecting plate 21. The conductive patterns e are soldered to the electrode pad 4*a* of the plug-side substrate 4.

(Operation)

Figure 18:
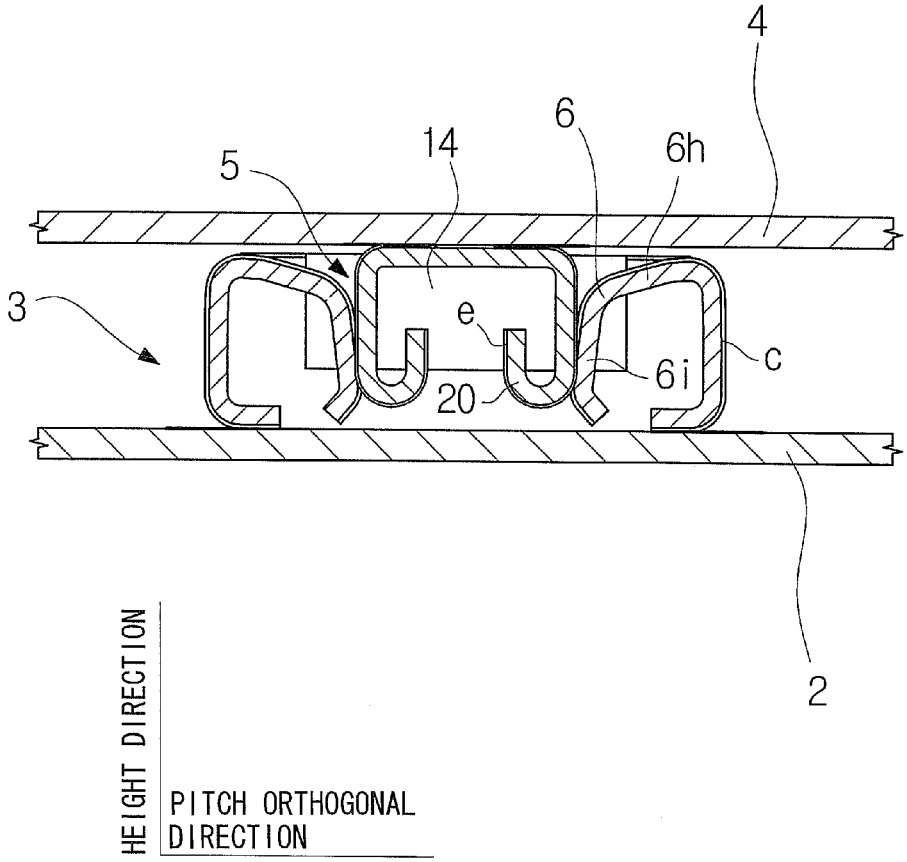
FIG. 18 is a sectional view showing a state where the receptacle connector and the plug connector are fit together (second exemplary embodiment)

Next, an operation of the connector unit 1 will be described. Referring first to FIGS. 15 and 17, the receptacle connector 3 is mounted on the receptacle-side substrate 2 and the plug connector 5 is mounted on the plug-side substrate 4. Referring next to FIG. 18, the plug connector 5 is inserted into the insertion opening 11 of the receptacle connector 3. The second curved portion 14 formed at the peripheral edge 12 of the insertion opening 11 facilitates insertion of the plug connector 5 into the insertion opening 11 of the receptacle connector 3. When the plug connector 5 is inserted into the insertion opening 11 of the receptacle connector 3, the U-shaped portions 20 of the plug connector 5 push the bent portions 6*i* of the cantilevers 6 in the pitch orthogonal anti-center direction. Then, the cantilevers 6 are allowed to strongly contact the U-shaped portions 20 of the plug connector 5 by a self elastic restoring force. This contact achieves continuity between each conductive pattern c of the receptacle connector 3 and each conductive pattern e of the plug connector 5.

The second exemplary embodiment of the present invention has been described above. In short, the second exemplary embodiment has the following features.

The receptacle connector 3 (housingless connector) is formed of a single metal plate g and is used to be mounted on the receptacle-side substrate 2. The receptacle connector 3 includes the plurality of cantilevers 6 arranged in a comb shape and functioning as contacts, and the outer frame body 7 surrounding the plurality of cantilevers 6. According to the configuration described above, the plurality of cantilevers 6 is surrounded by the outer frame body 7, thereby preventing the cantilevers from being damaged.

The outer frame body 7 includes the pair of side plates 9 sandwiching the plurality of cantilevers 6 in the direction parallel to the connector mounting surface 2*a* of the receptacle-side substrate 2, and the top plate 8 disposed on the opposite side of the receptacle-side substrate 2 with the plurality of cantilevers 6 interposed therebetween. According to the configuration described above, the plurality of cantilevers 6 is surrounded to be covered by the outer frame body 7, thereby further preventing the cantilevers from being damaged.

The outer frame body 7 further includes the base plates 40 (first substrate fixed portions) which are respectively connected to the side plates 9 and fixed to the connector mounting surface 2*a* of the receptacle-side substrate 2. In the configuration described above, when the base plates 40 are fixed to the connector mounting surface 2*a* of the receptacle-side substrate 2, the receptacle connector 3 is fixed to the receptacle-side substrate 2.

The top plate 8 includes the insertion opening 11 into which the plug connector 5 (counterpart connector) is inserted. In the configuration described above, when the receptacle connector 3 and the plug connector 5 are fit together, the plug connector 5 is inserted into the insertion opening 11, thereby allowing the plug connector 5 to contact the plurality of cantilevers 6. During the insertion, the top plate 8 itself exerts the guide function of guiding the plug connector 5 to the plurality of cantilevers 6.

The top plate 8 includes the seamless peripheral edge 12 surrounding the insertion opening 11. According to the configuration described above, the above-mentioned guide function can be achieved more smoothly, compared with the case where the peripheral edge 12 has a cut.

The second curved surface 14*a* is formed at the peripheral edge 12. According to the configuration described above, the above-mentioned guide function can be achieved more smoothly.

Note that an inclined surface that is inclined in the substrate approaching direction may be formed in place of the second curved surface 14*a*.

The plurality of cantilevers 6 is formed to extend toward the receptacle-side substrate 2. According to the configuration described above, in the case of inserting the plug connector 5 into the insertion opening 11, the plug connector 5 is prevented from causing each cantilever 6 to be deformed to buckle.

<Second Exemplary Embodiment: First Modified Example>

Figure 19:
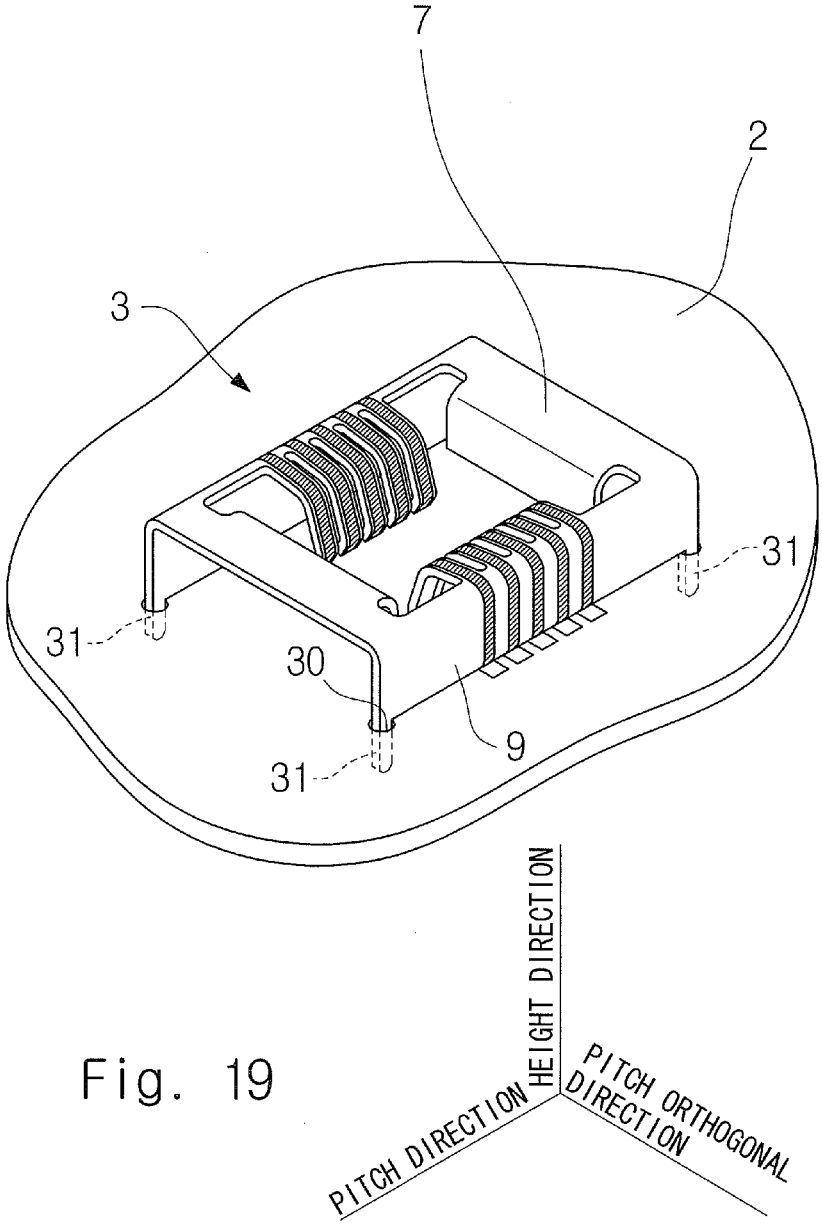
FIG. 19 is a perspective view of a receptacle connector (a first modified example of the second exemplary embodiment)

Referring next to FIG. 19, a first modified example of the second exemplary embodiment will be described.

In the second exemplary embodiment described above, to mount the receptacle connector 3 on the receptacle-side substrate 2, the receptacle connector 3 includes the base plates 40, which are soldered to the receptacle-side substrate 2, at the lower ends 9*a* of the side plates 9 as shown in FIG. 15.

Alternatively, as shown in FIG. 19, the receptacle connector 3 may include the pins 31 (first substrate fixed portions), which are inserted into the through-holes 30 formed in the receptacle-side substrate 2 and soldered to the receptacle-side substrate 2, at the end portions in the pitch direction of the side plates 9. That is, the outer frame body 7 may further include the pins 31 which are respectively connected to the side plates 9 and fixed to the receptacle-side substrate 2. The presence of the pins 31 improves the strength for mounting the receptacle connector 3 to the receptacle-side substrate 2.

Further, as in the second modified example of the first exemplary embodiment described above, the hold-down 32 (second substrate fixed portion) may be further provided at the center in the pitch orthogonal direction at the end portion in the pitch direction of the top plate 8. Furthermore, as in the third modified example of the first exemplary embodiment, the pin 34 (second substrate fixed portion) which is inserted into each through-hole 33 formed in the receptacle-side substrate 2 and soldered to the receptacle-side substrate 2 may be further provided.

<Third Exemplary Embodiment>

Referring next to FIGS. 20 to 26, a third exemplary embodiment of the present invention will be described. Herein, the differences between this exemplary embodiment and the first exemplary embodiment will be mainly described, and a repeated description is omitted as needed. The components corresponding to the components of the first exemplary embodiment described above are denoted by the same reference numerals as a general rule.

(Connector Unit 1)

Figure 20:
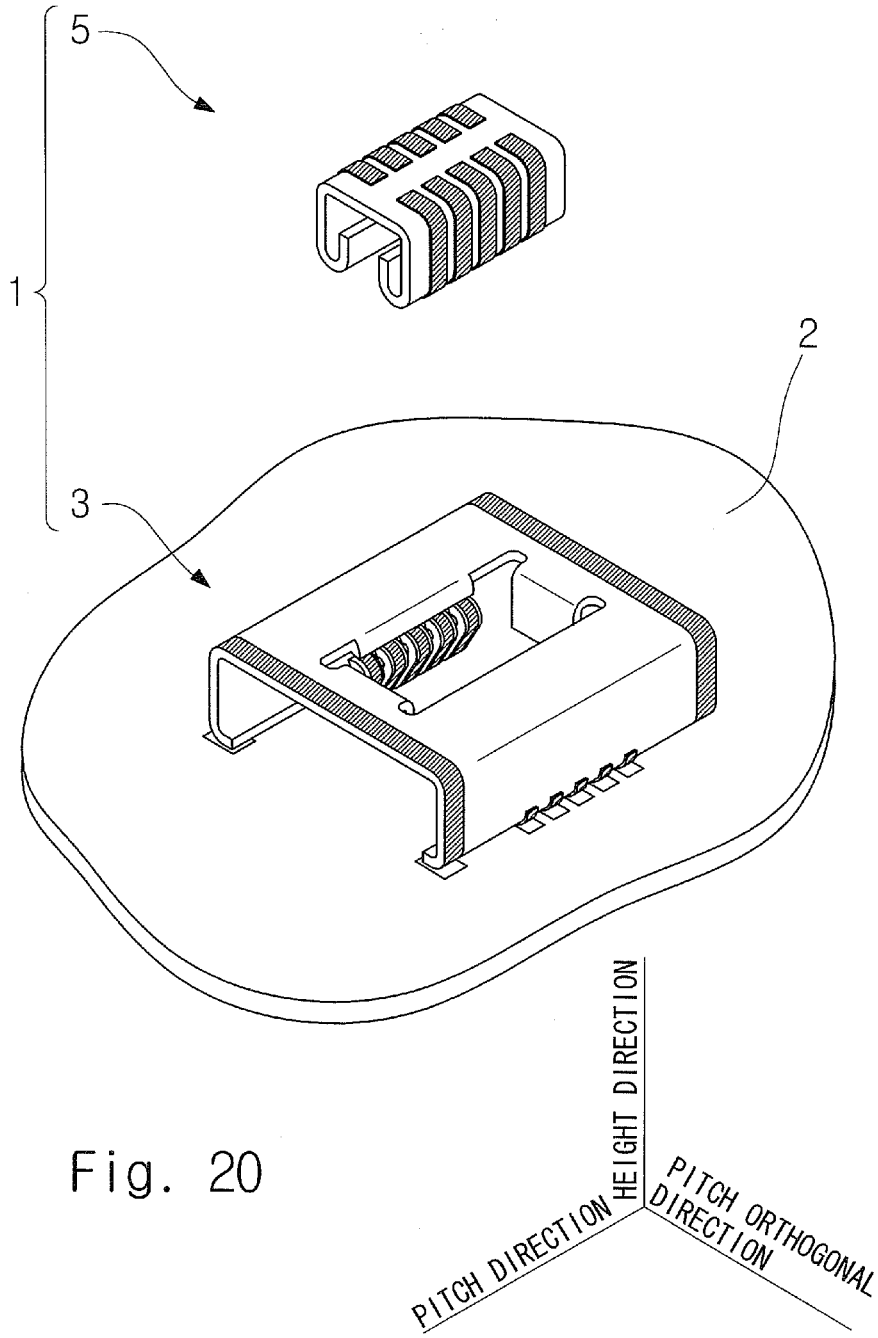
FIG. 20 is a perspective view showing a state where a plug connector is removed from a receptacle connector (third exemplary embodiment)
Figure 25:
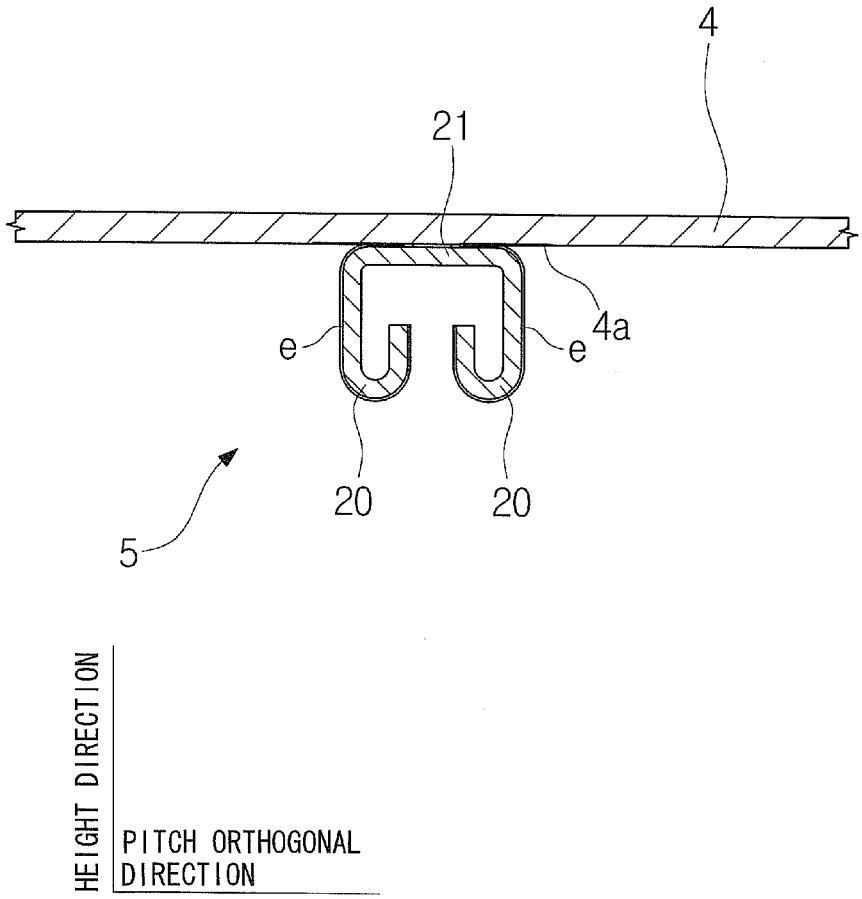
FIG. 25 is a sectional view taken along the line XXV-XXV of FIG. 24(third exemplary embodiment.

As shown in FIG. 20, the connector unit 1 includes the receptacle connector 3 which is used to be mounted on the receptacle-side substrate 2, and the plug connector 5 which is used to be mounted on the plug-side substrate 4 (also see FIG. 25).

(Receptacle Connector 3)

Figure 21:
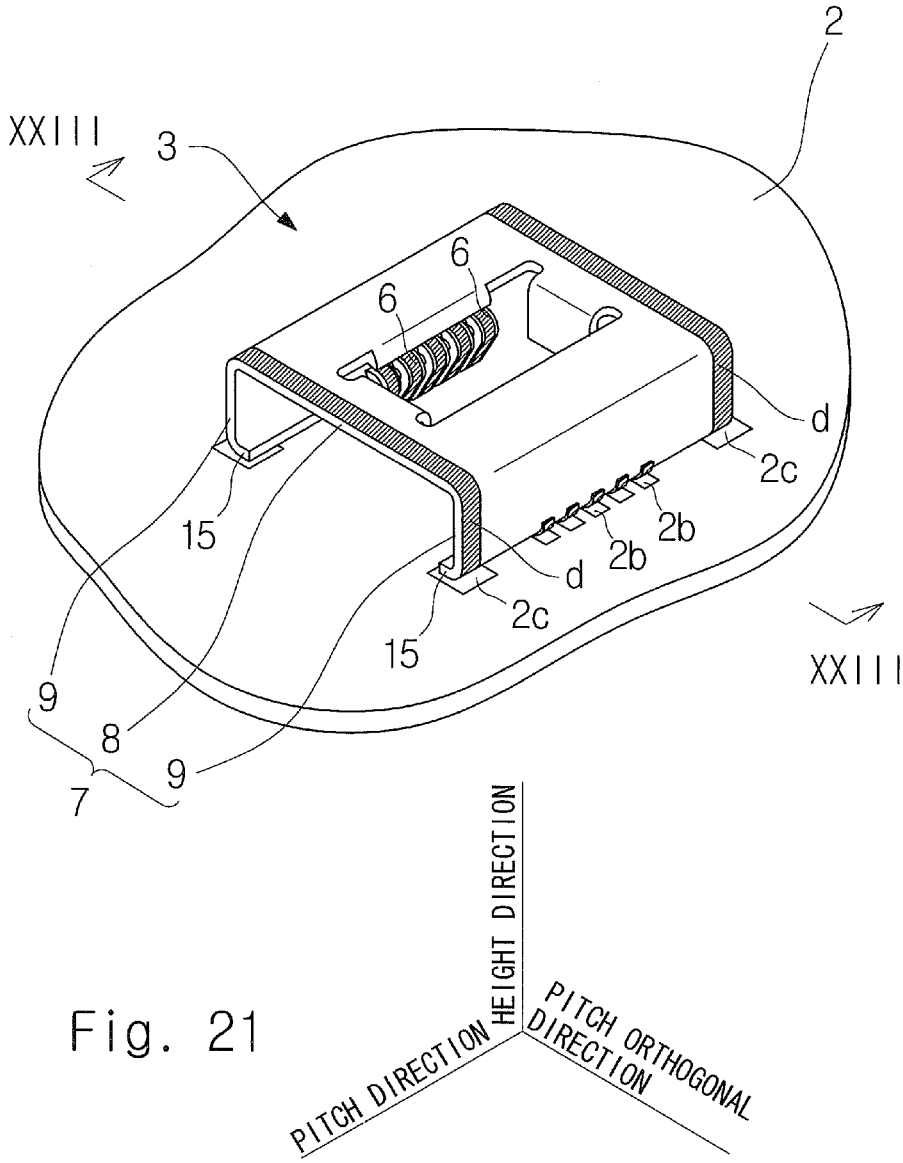
FIG. 21 is a perspective view of the receptacle connector (third exemplary embodiment)
Figure 22:
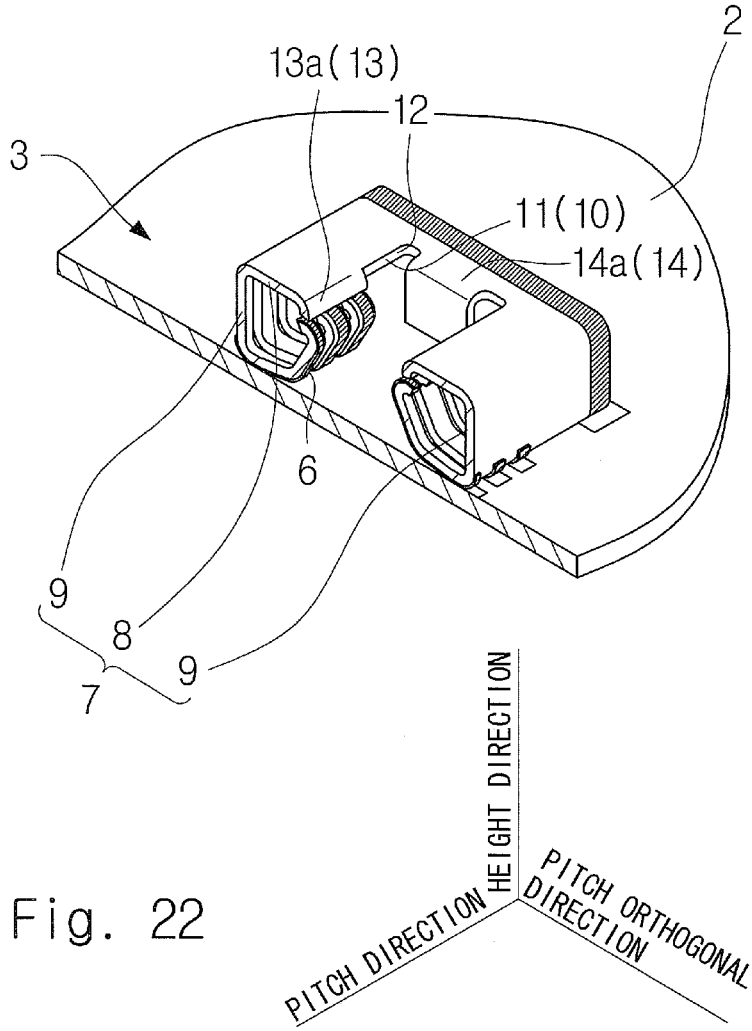
FIG. 22 is a partially cutaway perspective view of the receptacle connector (third exemplary embodiment)
Figure 23:
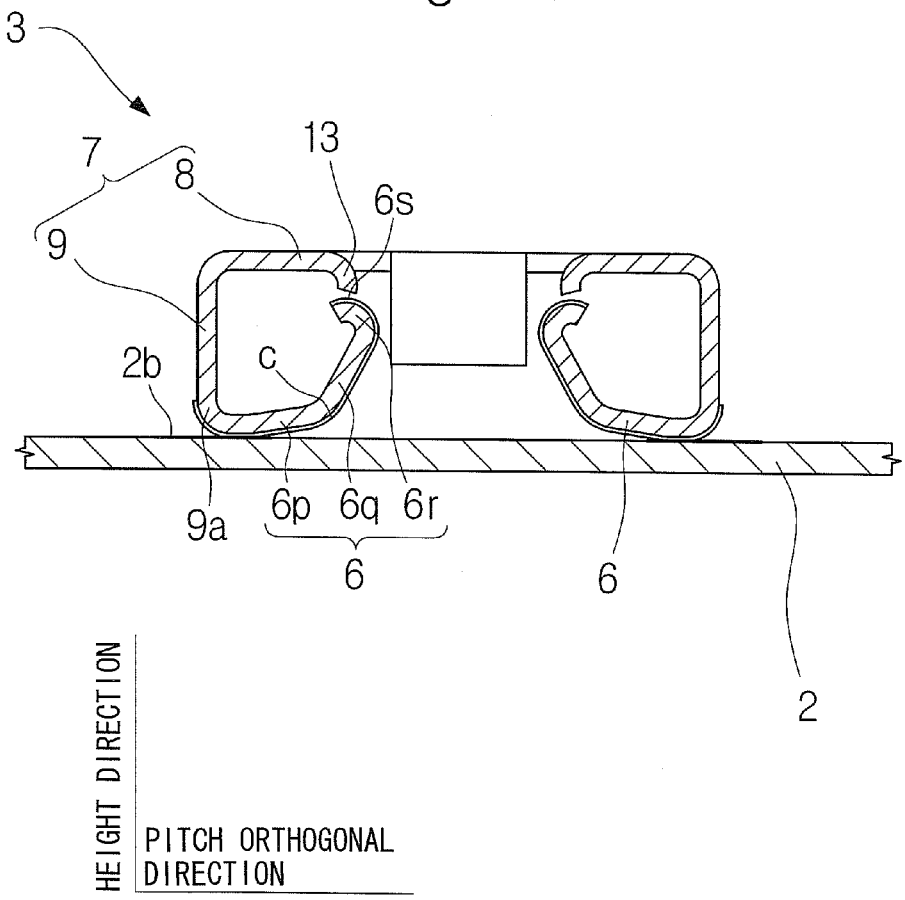
FIG. 23 is a sectional view taken along the line XXIII-XXIII of FIG. 21 (third exemplary embodiment)

As shown in FIGS. 21 to 23, the receptacle connector 3 includes the plurality of cantilevers 6 and the outer frame body 7.

(Outer Frame Body 7)

As shown in FIGS. 21 and 22, the outer frame body 7 includes the top plate 8 and the pair of side plates 9.

(Outer Frame Body 7: Top Plate 8)

As shown in FIG. 22, the top plate 8 includes the insertion opening unit 10 into which the plug connector 5 is inserted. The insertion opening unit 10 is formed of a single insertion opening 11. Specifically, the top plate 8 includes a single insertion opening 11. In the other words, the top plate 8 is annularly formed to surround a single insertion opening 11. The top plate 8 includes the seamless peripheral edge 12 surrounding the insertion opening 11. The pair of first curved portions 13 and the pair of second curved portions 14 are formed at the peripheral edge 12. The pair of first curved portions 13 is formed on the side of the pitch orthogonal anti-center direction when viewed from the insertion opening 11. The pair of second curved portions 14 is formed on the side of the pitch anti-center direction when viewed from the insertion opening 11. Each of the first curved portions 13 has the first curved surface 13*a* (curved surface). Each of the second curved portions 14 has the second curved surface 14*a* (curved surface).

(Outer Frame Body 7: Hold-downs 15)

As shown in FIG. 21, the hold-downs 15 (first substrate fixed portions) which are used to solder the receptacle connector 3 to the receptacle-side substrate 2 are formed at lower ends of the end portions in the pitch direction of the side plates 9. Each of the hold-downs 15 is formed to be bent in the pitch orthogonal center direction from the side plates 9.

(Cantilevers 6)

As shown in FIGS. 22 and 23, each of the cantilevers 6 extends away from the receptacle-side substrate 2. Specifically, as shown in FIG. 23, each of the cantilevers 6 includes a linear portion 6*p* which is connected to the lower end 9*a* of the corresponding side plate 9 and extends in the pitch orthogonal center direction; an inclined portion 6*q* which is connected to the linear portion 6*p* and inclined to be away from the receptacle-side substrate 2 toward the pitch orthogonal center direction; and a curved portion 6*r* which is connected to the inclined portion 6*q* and curved toward the pitch orthogonal anti-center direction. It can be said that the presence of the inclined portion 6*q* allows formation of the cantilevers 6 that extend away from the receptacle-side substrate 2. Furthermore, an apex 6*s*, which is a portion of each of the cantilevers 6 that is farthest from the receptacle-side substrate 2, is covered by the top plate 8. Specifically, the apex 6*s* of each of the cantilevers 6 is covered by the corresponding first curved portion 13 which is a part of the top plate 8.

(Conductive Patterns c)

As shown in FIG. 23, the conductive patterns c are formed over the cantilevers 6 and the side plates 9. Specifically, the conductive patterns c are formed in the range from the curved portion 6*r* of each of the cantilevers 6 to each of the side plates 9. The conductive patterns c are soldered to the respective electrode pads 2*b* of the receptacle-side substrate 2.

(Hold-down Patterns d)

As shown in FIG. 21, the receptacle connector 3 has the pair of hold-down patterns d. The hold-down patterns d are formed over one of the hold-downs 15, the side plate 9, the top plate 8, the side plate 9, and the other hold-down 15. The hold-down patterns d are soldered to the holding-down pads 2*c* of the receptacle-side substrate 2.

(Plug Connector 5)

Figure 24:
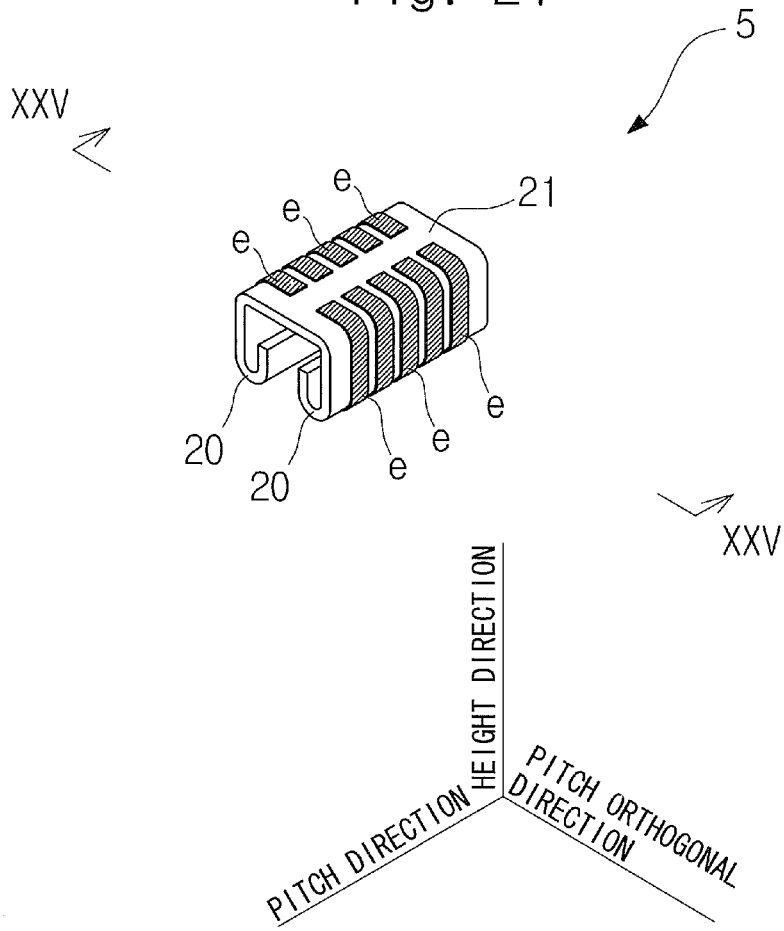
FIG. 24 is a perspective view of the plug connector (third exemplary embodiment)

As shown in FIGS. 24 and 25, the plug connector 5 includes the pair of U-shaped portions 20 functioning as contacts, and the connecting plate 21 that connects the pair of U-shaped portions 20. Note that FIG. 25 depicts the plug-side substrate 4, for convenience of explanation.

(Conductive Patterns e)

The plug connector 5 has the plurality of conductive patterns e. The conductive patterns e are formed over the U-shaped portions 20 and the connecting plate 21. The conductive patterns e are soldered to the electrode pad 4*a* of the plug-side substrate 4.

(Operation)

Figure 26:
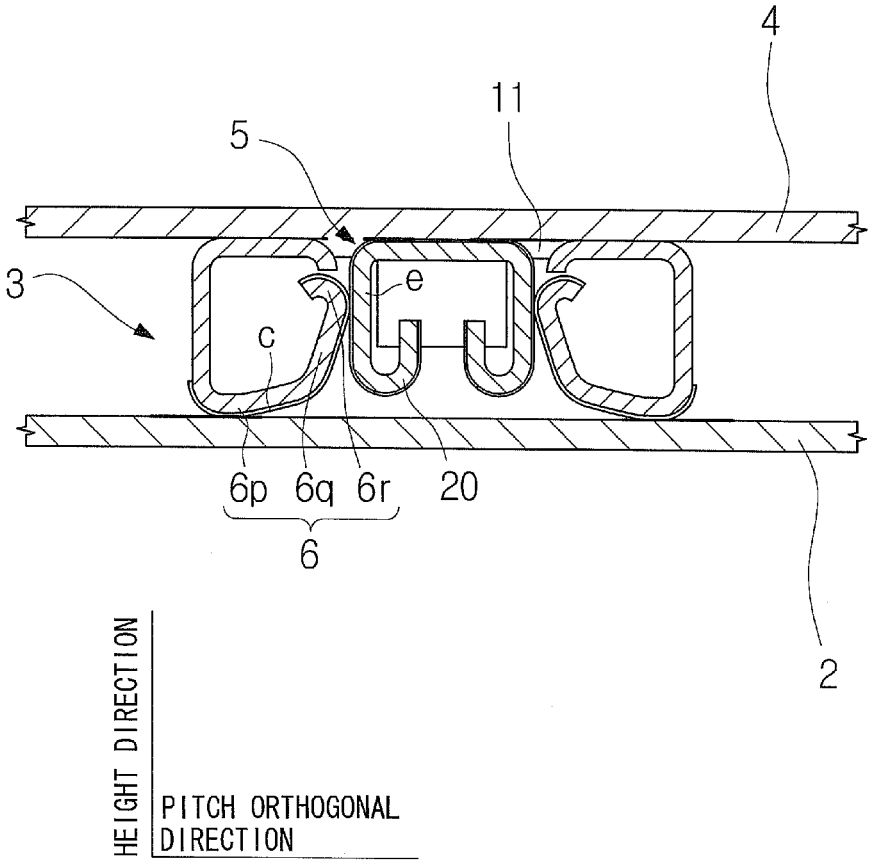
FIG. 26 is a sectional view showing a state where the receptacle connector and the plug connector are fit together (third exemplary embodiment)
Figure 28:
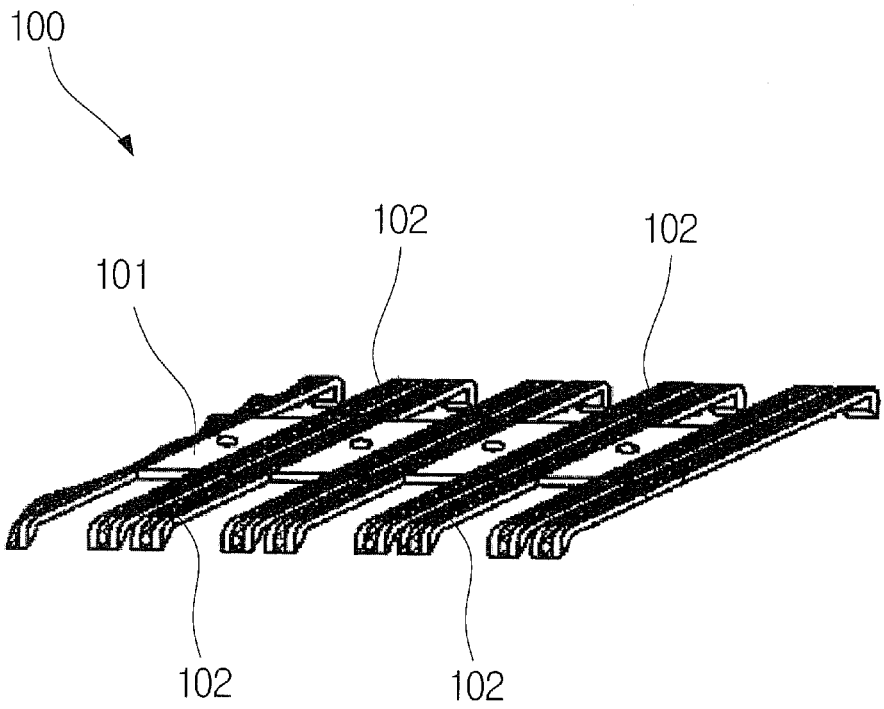
FIG. 28 is a diagram corresponding to FIG. 4 of Japanese Unexamined Patent Application Publication No. 2003-142183.

Next, an operation of the connector unit 1 will be described. Referring first to FIGS. 23 and 25, the receptacle connector 3 is mounted on the receptacle-side substrate 2 and the plug connector 5 is mounted on the plug-side substrate 4. Referring next to FIG. 26, the plug connector 5 is inserted into the insertion opening 11 of the receptacle connector 3. As shown in FIG. 22, the first curved portions 13 and the second curved portions 14, which are formed at the peripheral edge 12 of the insertion opening 11, facilitate insertion of the plug connector 5 into the insertion opening 11 of the receptacle connector 3. Returning to FIG. 26, when the plug connector 5 is inserted into the insertion opening 11 of the receptacle connector 3, the U-shaped portions 20 of the plug connector 5 push the curved portion 6*r* of each of the cantilevers 6 in the pitch orthogonal anti-center direction. Then, the cantilevers 6 are allowed to strongly contact the U-shaped portions 20 of the plug connector 5 by a self elastic restoring force. This contact achieves continuity between each conductive pattern c of the receptacle connector 3 and each conductive pattern e of the plug connector 5.

The third exemplary embodiment of the present invention has been described above. In short, the third exemplary embodiment described above has the following features.

The receptacle connector 3 (housingless connector) is formed of a single metal plate g and is used to be mounted on the receptacle-side substrate 2. The receptacle connector 3 includes the plurality of cantilevers 6 arranged in a comb shape and functioning as contacts, and the outer frame body 7 surrounding the plurality of cantilevers 6. According to the configuration described above, the plurality of cantilevers 6 is surrounded by the outer frame body 7, thereby preventing the cantilevers from being damaged.

Further, the outer frame body 7 includes the pair of side plates 9 sandwiching the plurality of cantilevers 6 in the direction parallel to the connector mounting surface 2*a* of the receptacle-side substrate 2, and the top plate 8 disposed on the opposite side of the receptacle-side substrate 2 with the plurality of cantilevers 6 interposed therebetween. According to the configuration described above, the plurality of cantilevers 6 is surrounded to be covered by the outer frame body 7, thereby further preventing the cantilevers from being damaged.

The outer frame body 7 further includes the hold-downs 15 (first substrate fixed portions) which are respectively connected to the side plates 9 and fixed to the connector mounting surface 2*a* of the receptacle-side substrate 2. In the configuration described above, when the hold-downs 15 are fixed to the connector mounting surface 2*a* of the receptacle-side substrate 2, the receptacle connector 3 is fixed to the receptacle-side substrate 2.

The top plate 8 includes the insertion opening 11 into which the plug connector 5 (counterpart connector) is inserted. In the configuration described above, when the receptacle connector 3 and the plug connector 5 are fit together, the plug connector 5 is inserted into the insertion opening 11, thereby allowing the plug connector 5 to contact the plurality of cantilevers 6. During the insertion, the top plate 8 itself exerts the guide function of guiding the plug connector 5 to the plurality of cantilevers 6.

The top plate 8 further includes the seamless peripheral edge 12 surrounding the insertion opening 11. According to the configuration described above, the above-mentioned guide function can be achieved more smoothly, compared with the case where the peripheral edge 12 has a cut.

Further, the first curved surface 13*a* and the second curved surface 14*a* are formed at the peripheral edge 12. According to the configuration described above, the above-mentioned guide function can be achieved more smoothly.

Note that an inclined surface that is inclined in the substrate approaching direction may be formed in place of the first curved surface 13*a* and the second curved surface 14*a*.

The plurality of cantilevers 6 is formed to extend away from the receptacle-side substrate 2, and the top plate 8 covers the apex 6*s* which is a portion of each of the cantilevers 6 that is farthest from the receptacle-side substrate 2. According to the configuration described above, when the plug connector 5 is inserted into the insertion opening 11, the plug connector 5 is prevented from causing the cantilevers 6 to be deformed to buckle.

<Third Exemplary Embodiment: First Modified Example>

Referring next to FIG. 27, a first modified example of the third exemplary embodiment will be described.

As shown in FIG. 21, in the third exemplary embodiment described above, to mount the receptacle connector 3 on the receptacle-side substrate 2, the receptacle connector 3 includes the hold-downs 15, which are soldered to the receptacle-side substrate 2, at the lower ends of the end portions in the pitch direction of the side plates 9.

Alternatively, as shown in FIG. 27, the receptacle connector 3 may include the pins 31 (first substrate fixed portions), which are inserted into the through-holes 30 formed in the receptacle-side substrate 2 and soldered to the receptacle-side substrate 2, at the lower ends of the end portions in the pitch direction of the side plates 9. That is, the outer frame body 7 may further include the pins 31 which are connected to the side plates 9 and fixed to the receptacle-side substrate 2. The presence of the pins 31 improves the strength for mounting the receptacle connector 3 to the receptacle-side substrate 2.

Further, as in the second modified example of the first exemplary embodiment described above, the hold-down 32 (second substrate fixed portion) may be further provided at the center in the pitch orthogonal direction at the end portion in the pitch direction of the top plate 8. Furthermore, as in the third modified example of the first exemplary embodiment described above, the pin 34 (second substrate fixed portion) which is inserted into each through-hole 33 formed in the receptacle-side substrate 2 and is soldered to the receptacle-side substrate 2 may be further provided.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A connector that is formed of a single metal plate and used to be mounted on a substrate, the connector comprising:

a plurality of cantilevers arranged in a comb shape and functioning as contacts; and an outer frame body surrounding the plurality of cantilevers, wherein the plurality of cantilevers is allowed to function as contacts by forming an insulating layer on the metal plate and forming a desired conductive pattern on the insulating layer.

2. The connector according to claim 1, wherein the outer frame body includes:

a pair of side plates sandwiching the plurality of cantilevers in a direction parallel to the substrate; and a top plate disposed above the substrate with the plurality of cantilevers interposed therebetween.

3. The connector according to claim 2, wherein the outer frame body further includes a substrate fixed portion that is connected to the side plates and fixed to the substrate.

4. The connector according to claim 2, wherein the outer frame body further includes a substrate fixed portion that is connected to the top plate and extends toward the substrate to be fixed to the substrate.

5. The connector according to claim 2, wherein the top plate includes an insertion opening into which a counterpart connector is inserted.

6. The connector according to claim 5, wherein the top plate includes a seamless peripheral edge surrounding the insertion opening.

7. The connector according to claim 6, wherein the peripheral edge has one of an inclined surface and a curved surface.

8. The connector according to claim 2, wherein the plurality of cantilevers is formed to extend away from the substrate, and the top plate covers an apex of each of the cantilevers, the apex being farthest from the substrate.

9. The connector according to claim 2, wherein the plurality of cantilevers is formed to extend toward the substrate.

* * * * *